US012466680B2

(12) United States Patent
Yamane et al.

(10) Patent No.: US 12,466,680 B2
(45) Date of Patent: Nov. 11, 2025

(54) FILM ROLL SUPPLY DEVICE

(71) Applicant: ISHIDA CO., LTD., Kyoto (JP)

(72) Inventors: Masayuki Yamane, Ritto (JP); Makoto Ichikawa, Ritto (JP); Satoshi Hashimoto, Ritto (JP); Yuchuan Tong, Ritto (JP); Masaki Shinkawa, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 264 days.

(21) Appl. No.: 18/351,502

(22) Filed: Jul. 13, 2023

(65) Prior Publication Data

US 2024/0017948 A1 Jan. 18, 2024

(30) Foreign Application Priority Data

Jul. 15, 2022 (JP) ..... 2022-113758
Jun. 5, 2023 (JP) ..... 2023-092395

(51) Int. Cl.
*B65H 19/12* (2006.01)
*B65B 41/16* (2006.01)

(52) U.S. Cl.
CPC ..... *B65H 19/12* (2013.01); *B65B 41/16* (2013.01); *B65H 2511/14* (2013.01); *B65H 2511/20* (2013.01); *B65H 2553/40* (2013.01)

(58) Field of Classification Search
None
See application file for complete search history.

(56) References Cited

U.S. PATENT DOCUMENTS 4,913,366 A * 4/1990 Andou ..... B65H 26/08 242/563.2
5,269,479 A * 12/1993 Budin ..... B65H 19/123 242/559.4
5,274,984 A * 1/1994 Fukuda ..... B65B 41/16 414/908
5,285,978 A 2/1994 Sakano et al.
(Continued)

FOREIGN PATENT DOCUMENTS

EP 0524828 B1 12/1995
JP 2002-337817 A 11/2002
WO 2016/173853 A1 11/2016

OTHER PUBLICATIONS

Search Report from the corresponding European Patent Application No. 23185339.1 issued on Dec. 12, 2023.

*Primary Examiner* — William A. Rivera
(74) *Attorney, Agent, or Firm* — United IP Counselors, LLC

(57) ABSTRACT

A film roll replacement device supplies a film roll to a bag making and packaging machine. The film roll replacement device includes a holding section, a driving unit, and a controller. The holding section is at least temporarily located adjacent to a supporting shaft to support the film roll in the bag making and packaging machine, and the holding section holds a first film roll supplied to the bag making and packaging machine. The driving unit moves the holding section in an up-down direction. The controller controls an action of the driving unit to move the holding section to a position where a height position of a center of the first film roll held by the holding section is aligned with the height of a center of the supporting shaft of the bag making and packaging machine.

11 Claims, 19 Drawing Sheets

(56) References Cited

U.S. PATENT DOCUMENTS

| | | | | |
|---|---|---|---|---|
| 2018/0141772 | A1* | 5/2018 | Prankl | B65H 19/12 |
| 2020/0108960 | A1* | 4/2020 | Shimoda | B65B 51/16 |
| 2024/0083705 | A1* | 3/2024 | Yamane | B65H 19/123 |
| 2024/0317443 | A1* | 9/2024 | Yamane | B65H 19/105 |

* cited by examiner

FILM ROLL SUPPLY DEVICE

CROSS-REFERENCE TO RELATED APPLICATIONS

This application is based on and claims the priority benefit of Japanese patent applications Nos. 2022-113758 filed Jul. 15, 2022, and 2023-092395 filed Jun. 5, 2023, the contents of both of which are incorporated herein by reference.

TECHNICAL FIELD

The claimed invention relates to a film roll supply device to supply a film roll to a bag making and packaging machine.

BACKGROUND ART

Bag making and packaging machines, which package articles using film paying out from a film roll to manufacture bags containing the articles, are known, as in Patent Literature 1 (Japanese Laid-open Patent Publication No. 2002-337817).

Mounting a film roll in such a bag making and packaging machine is done using a manual method, such as one described in Patent Literature 1 (Japanese Laid-open Patent Publication No. 2002-337817), in which a worker lifts a film roll and installs the film roll directly on a supporting shaft of a bag making and packaging machine: in which a worker lifts the film roll to a predetermined height, places the film roll on a cart, and then horizontally slides the film roll on the cart to install the film roll on a supporting shaft of the bag making and packaging machine.

SUMMARY OF THE INVENTION

However, a film roll is a heavy object, and it is therefore a burden to a worker to lift the film roll and position the film roll at such a height that a height position of a center of the film roll is aligned with a height position of a center of the supporting shaft of the bag making and packaging machine.

An object of the claimed invention is to reduce the burden of installing the film roll in the bag making and packaging machine.

A film roll supply device according to a first aspect of the claimed invention is configured to supply a film roll to a bag making and packaging machine. The film roll supply device comprises a holding section, a driving unit, and a control unit. The holding section is configured at least temporarily to be located adjacent to a supporting shaft to support the film roll in the bag making and packaging machine, and the holding section is configured to hold a first film roll serving as the film roll supplied to the bag making and packaging machine. The driving unit is configured to move the holding section in an up-down direction. The control unit is configured to control an action of the driving unit to move the holding section to a position where a height position of a center of the first film roll held by the holding section is aligned with a height of a center of the supporting shaft of the bag making and packaging machine.

With the film roll supply device according to the first aspect of the claimed invention, the burden on the worker can be reduced because the height position of the film roll, which is a heavy object, supplied to the bag making and packaging machine is automatically adjusted.

A film roll supply device according to a second aspect of the claimed invention is the film roll supply device of the first aspect, further comprising a first measuring unit. The first measuring unit is configured to measure a diameter of the first film roll. The control unit is configured to control the action of the driving unit based on a measurement result from the first measuring unit to move the holding section to a position where the height position of the center of the first film roll held by the holding section is aligned with the height of the center of the supporting shaft of the bag making and packaging machine.

With the film roll supply device of the second aspect, the position of the center of the first film roll and the position of the center of the supporting shaft can be aligned even if the diameter of the first film roll is not constant.

The film roll supply device according to a third aspect of the claimed invention is the film roll supply device of the second aspect, further comprising a first member and a movement mechanism. The movement mechanism is configured to move the first member from a first position to a second position where the first member contacts with an outer peripheral surface of the first film roll. The first measuring unit is configured to measure the diameter of the first film roll based on a distance the first member moves from the first position to the second position.

With the film roll supply device of the third aspect, the diameter of the first film roll can be accurately measured because the diameter of the first film roll is measured based on the distance the first member moves so as to contact with the outer peripheral surface of the first film roll. Therefore, the center of the first film roll held by the holding section and the center of the supporting shaft of the bag making and packaging machine can be accurately aligned based on the accurately measured diameter of the first film roll.

The film roll supply device according to a fourth aspect of the claimed invention is the film roll supply device of the second aspect, further comprising a first member, a movement mechanism, and a first sensor. The movement mechanism is configured to move the first member to a position where the first member contacts with an outer peripheral surface of the first film roll. The first sensor is configured to contactlessly measure a first distance from a first reference position to the first member in contact with the outer peripheral surface of the first film roll. The first measuring unit is configured to measure the diameter of the first film roll based on the first distance.

With the film roll supply device of the fourth aspect, the diameter of the first film roll can be accurately measured because the diameter of the first film roll is measured based on the first distance from the first reference position to the first member in contact with the outer peripheral surface of the first film roll. Therefore, the center of the first film roll held by the holding section and the center of the supporting shaft of the bag making and packaging machine can be accurately aligned based on the accurately measured diameter of the first film roll.

A film roll supply device according to a fifth aspect of the claimed invention is the film roll supply device of the first aspect, further comprising a second measuring unit. The second measuring unit is configured to measure the height position of the center of the first film roll held by the holding section. Based on a measurement result from the second measuring unit, the control unit is configured to control the action of the driving unit to move the holding section to a position where the height position of the center of the first film roll held by the holding section is aligned with the height of the center of the supporting shaft of the bag making and packaging machine.

With the film roll supply device of the fifth aspect, using the second measuring unit makes it possible to align the position of the center of the first film roll and the position of the center of the supporting shaft even if the size of the film roll to be replaced differs depending on the film roll.

A film roll supply device according to a sixth aspect of the claimed invention is the film roll supply device of the fifth aspect, further comprising a second sensor. The second sensor is configured to contactlessly measure a second distance from a second reference position to the outer peripheral surface of the first film roll. The second measuring unit is configured to measure the height position of the center of the first film roll held by the holding section based on the second distance measurement result from the second sensor.

With the film roll supply device of the sixth aspect, the height position of the center of the first film roll can be measured using a comparatively simple configuration that uses a contactless second sensor.

A film roll supply device according to a seventh aspect of the claimed invention is the film roll supply device of any one of the first to sixth aspects, wherein the holding section has a first holding surface and a second holding surface to support the first film roll. When aligning the height position of the center of the first film roll held by the holding section and the height position of the center of the supporting shaft of the bag making and packaging machine, the control unit is configured to control the action of the driving unit and moves the holding section supporting the first film roll using the first holding surface, which is inclined with respect to a vertical plane, and the second holding surface. The second holding surface is arranged symmetrically to the first holding surface with respect to the vertical plane. The first holding surface and the second holding surface are arranged in a V shape when the holding section moved by the driving unit is viewed along the vertical plane.

With the film roll supply device of the seventh aspect, the height position of the center of the first film roll and the height position of the center of the supporting shaft of the bag making and packaging machine can be accurately aligned by holding the first film roll using the holding section having the structure described above.

A film roll supply device according to an eighth aspect of the claimed invention is the film roll supply device described in the first aspect, further comprising a distance sensor configured to contactlessly measure a distance to an outer peripheral surface of the first film roll. The control unit is configured to control the action of the driving unit based on the distance measured by the distance sensor.

With the film roll supply device of the eighth aspect, the height position of the center of the first film roll can be measured in a short amount of time by using a contactless distance sensor.

A film roll supply device according to a ninth aspect of the claimed invention is the film roll supply device described in the first aspect, further comprising a storage unit configured to store a diameter of the film roll. The control unit is configured to control the action of the driving unit based on the diameter of the film roll stored in the storage unit.

With the film roll supply device of the ninth aspect, by storing the diameter of the film roll, the height position of the center of the film roll can be acquired in a shorter amount of time without measuring the film diameter each time.

The film roll supply device according to the claimed invention can reduce the burden on a worker because the height position of the film roll, which is a heavy object supplied to the bag making and packaging machine, is automatically adjusted.

DESCRIPTION OF EMBODIMENTS

A film roll replacement device 200 according to one embodiment of a film roll supply device of the present disclosure shall now be described with reference to the drawings. The following description is merely a specific example of the claimed invention, and does not limit the technical scope of the claimed invention. It will be understood that various changes in configuration and detail can be made without departing from the spirit and scope of the invention as set forth in the claims.

In the following description, expressions such as parallel, perpendicular, horizontal, vertical, orthogonal, identical, etc., may be used. Meanings of these expressions are not limited to strictly parallel, perpendicular, horizontal, vertical, orthogonal, identical, etc., may also be substantially parallel, perpendicular, horizontal, vertical, orthogonal, identical, etc.

For the sake of convenience, expressions such as "front (front surface)," "rear (back surface)," "up," "down," "left," and "right" may be used to indicate directions in the following description. Unless otherwise specified, these directional expressions represent the directions of the arrows added to the drawings.

(1) Bag Making and Packaging Machine and Weighing and Packaging System

Figure 1:
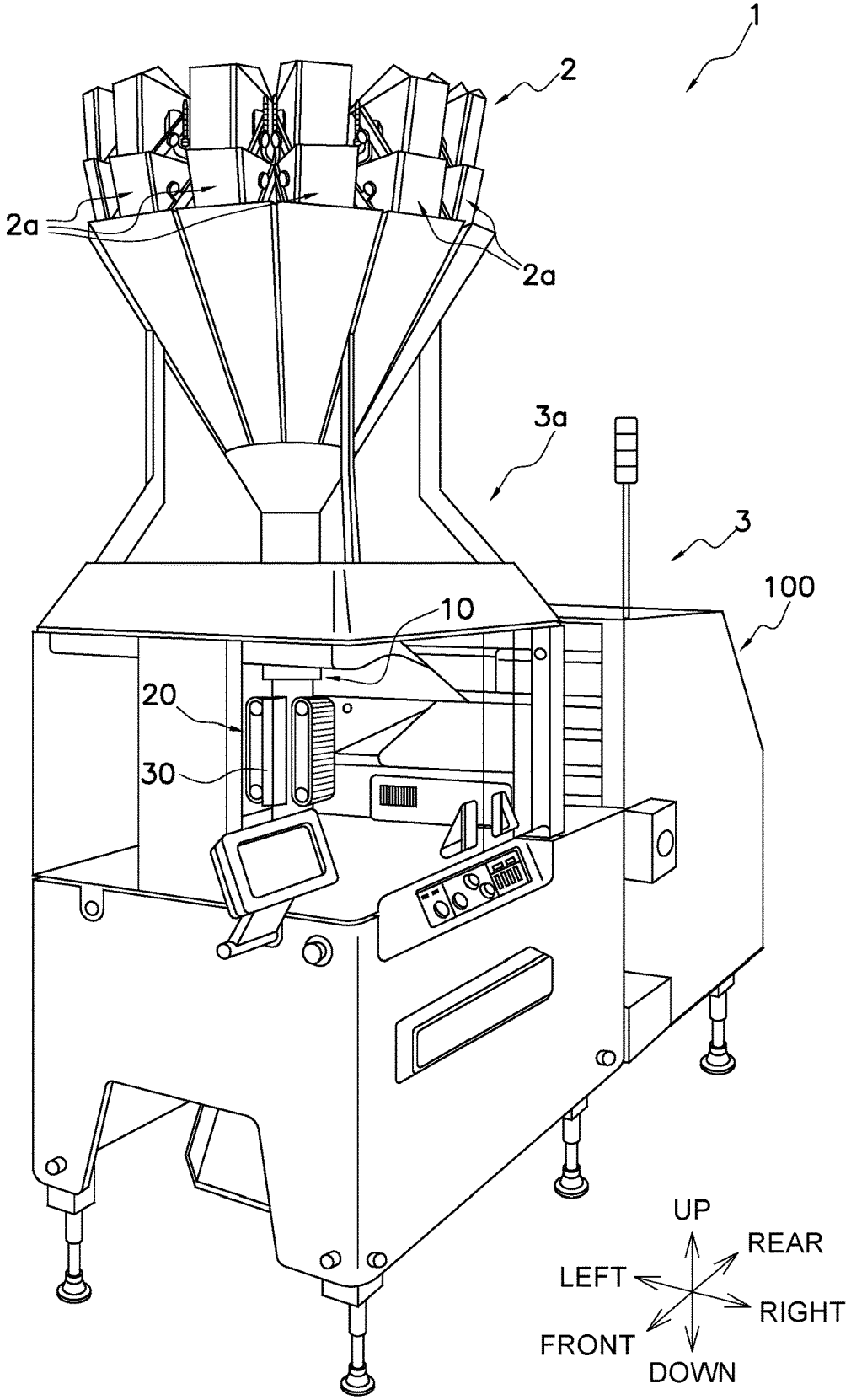
FIG. 1 is a schematic perspective view of a weighing and packaging system including a bag making and packaging machine to which a film roll is supplied by a film roll replacement device according to one embodiment of a film roll supply device of the claimed invention.
Figure 2:
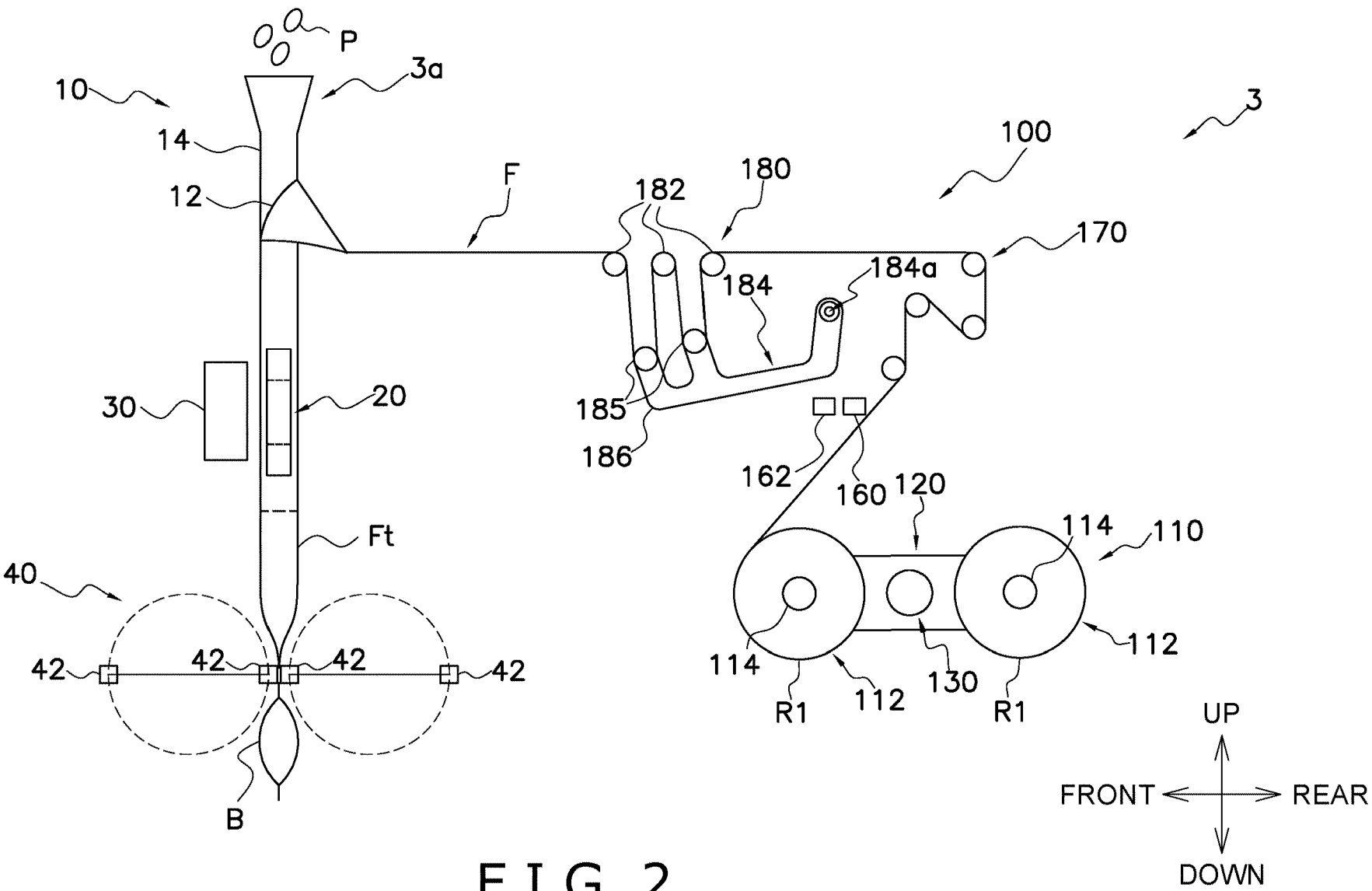
FIG. 2 is a schematic diagram of the bag making and packaging machine of FIG. 1.

First, a bag making and packaging machine 3, to which the film roll replacement device 200 supplies a film roll, and a weighing and packaging system 1 including the bag making and packaging machine 3, shall now be described with reference to FIGS. 1, 2, and 7. FIG. 1 is a schematic perspective view of the weighing and packaging system 1. FIG. 2 is a schematic diagram of the bag making and packaging machine 3. A control block diagram of the bag making and packaging machine 3 is shown in the lower part of FIG. 7.

The weighing and packaging system 1 mainly has a combination weighing machine 2 and the bag making and packaging machine 3 (see FIG. 1).

(1-1) Combination Weighing Machine

The combination weighing machine 2 mainly has a plurality of weighing hoppers 2*a* as in FIG. 1. The combination weighing machine 2 uses the plurality of weighing hoppers 2*a* to weigh articles P (e.g., potato chips) of a predetermined weight, and supplies the articles to the bag making and packaging machine 3 positioned thereunder. Specifically, the combination weighing machine 2 conveys and supplies articles P supplied from a supply conveyor (not shown in the figure) or the like to the plurality of weighing hoppers 2*a* using a conveying means (not shown in the figure). The combination weighing machine 2 measures the weight of the articles P supplied to each of the weighing hoppers 2*a* using a weighing means (not shown in the figure). The combination weighing machine 2 selects a combination of weighing hoppers 2*a* so that the total value of weight of the articles P in the selected weighing hoppers 2*a* will fall within a predetermined weight range. The combination weighing machine 2 supplies articles P of a predetermined weight to the bag making and packaging machine 3 by downwardly discharging the articles P in weighing hoppers 2*a* selected in a combination.

(1-2) Bag Making and Packaging Machine

The bag making and packaging machine 3 receives the supply of articles P from the combination weighing machine 2, forms a bag B from a sheet-shaped film F, and manufactures a bag B containing the articles P therein, as shown in FIG. 2. The bag making and packaging machine 3 mainly includes a bag making and packaging section 3*a*, a film supply section 100, and a packaging machine controller 4, as shown in FIGS. 1, 2, and 7.

The film supply section 100 holds a film roll R1 around which the sheet-shaped film F is wound, and supplies the film F paying out from the film roll R1 to the bag making and packaging section 3*a*. The bag making and packaging section 3*a* receives the supply of articles P from the combination weighing machine 2 and forms the sheet-shaped film F supplied from the film supply section 100 to manufacture bags B containing the articles P. The packaging machine controller 4 controls actions of various components of the bag making and packaging machine 3.

(1-2-1) Film Supply Section

The film supply section 100 is provided behind and adjacent to the bag making and packaging section 3*a* as in FIG. 1, and supplies the sheet-shaped film F to the forming mechanism 10 of the bag making and packaging section 3*a*. The film supply section 100 mainly includes a holding mechanism 110, a support frame 120, a frame shaft 130, a joining mechanism 160, a cutting mechanism 162, a plurality of rollers 170, and a tension-adjusting mechanism 180.

The holding mechanism 110 includes a pair of supporting parts 112 and a support-shaft-driving unit 116. Each of the pair of supporting parts 112 holds a film roll R1 in which a film F is wound around a hollow winding core WC. The film supply section 100 supplies the bag making and packaging section 3*a* with film F paying out from the film rolls R1 held by the supporting parts 112.

Due to the holding mechanism 110 having a plurality (two in this case) of supporting parts 112, the holding mechanism 110 can simultaneously hold a replacement film roll R1 in addition to the film roll R1 supplying film F to the bag making and packaging section 3*a* (the film roll R1 in use). Therefore, when the film F of the film roll R1 in use has been used up, manufacture of bags B can be restarted in a short period of time by using the film F of the replacement film roll R1.

The film F paying out from the film roll R1 supported on the supporting shaft 114 located in the film supply position is guided by a plurality of rollers 170 located along a predetermined film-conveying path of the film supply section 100, and conveyed to the forming mechanism 10 of the bag making and packaging section 3*a*.

One end of the shaft 184*a* is mounted to the encoder 188, which is for detecting a rotation angle of the shaft 184*a*. The encoder 188 senses the movements of the movable rollers 185. Detection results of the encoder 188 are used in, inter alia, control of the positions of the movable rollers 185 by the packaging machine controller 4.

(1-2-2) Packaging Machine Controller

The packaging machine controller 4 is a device that controls the actions of the components of the bag making and packaging machine 3. The packaging machine controller 4 has, for example, a CPU, storage devices such as a main storage device and an auxiliary storage device, an input/output device, and various electric circuits and electronic circuits. In the packaging machine controller 4, the CPU reads and executes programs stored in memory, whereby the actions of the components of the bag making and packaging section 3*a* and the film supply section 100 are controlled.

(2) Film Roll Supply Device (2-1) Overall Summary

A summary of the film roll replacement device 200 according to one embodiment of the claimed invention shall now be described with reference to FIGS. 3 to 9.

Figure 3:
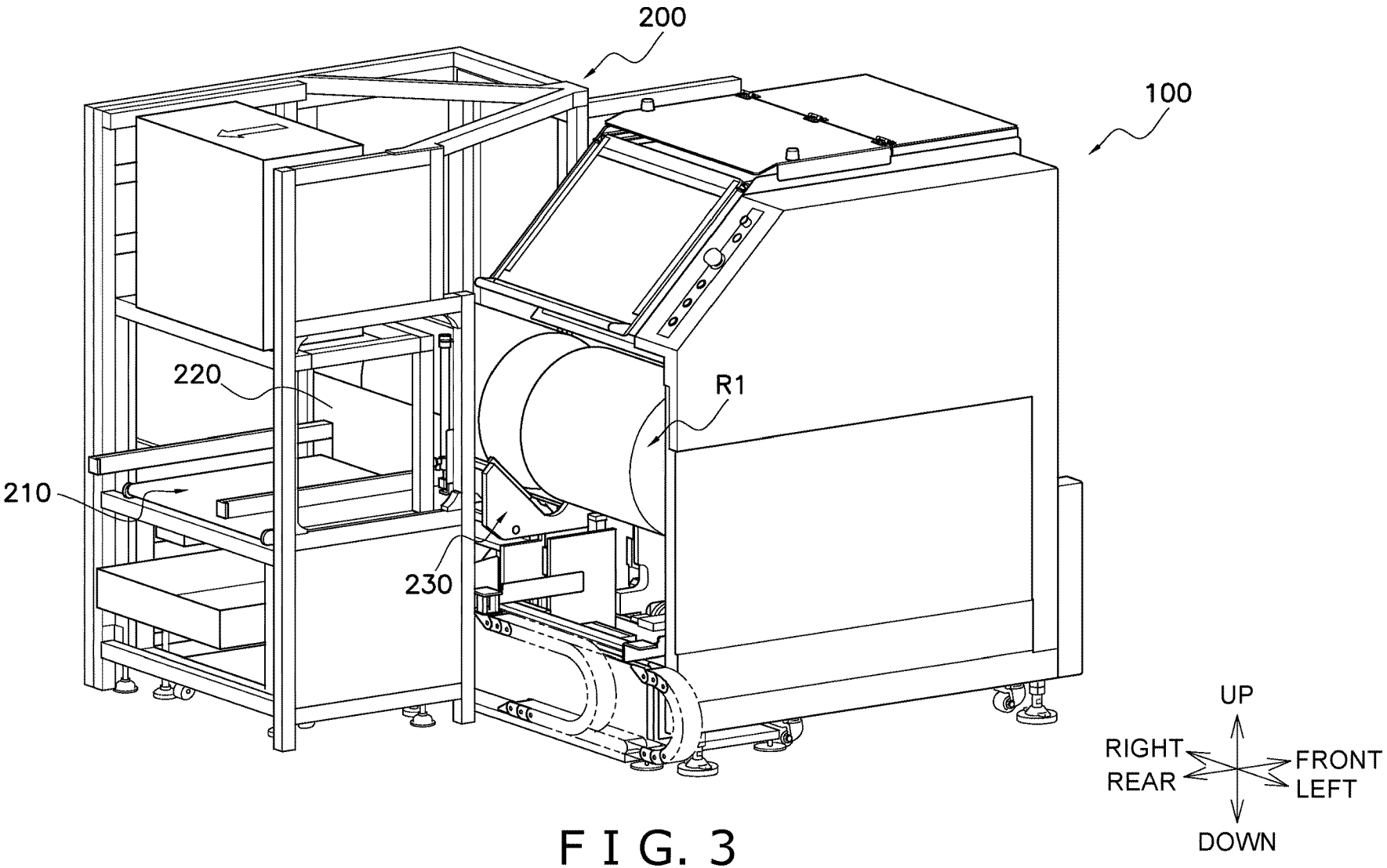
FIG. 3 is a schematic perspective view of a film supply section of the bag making and packaging machine of FIG. 1 and the film roll replacement device according to one embodiment of the claimed invention, as seen from the left rear.
Figure 4:
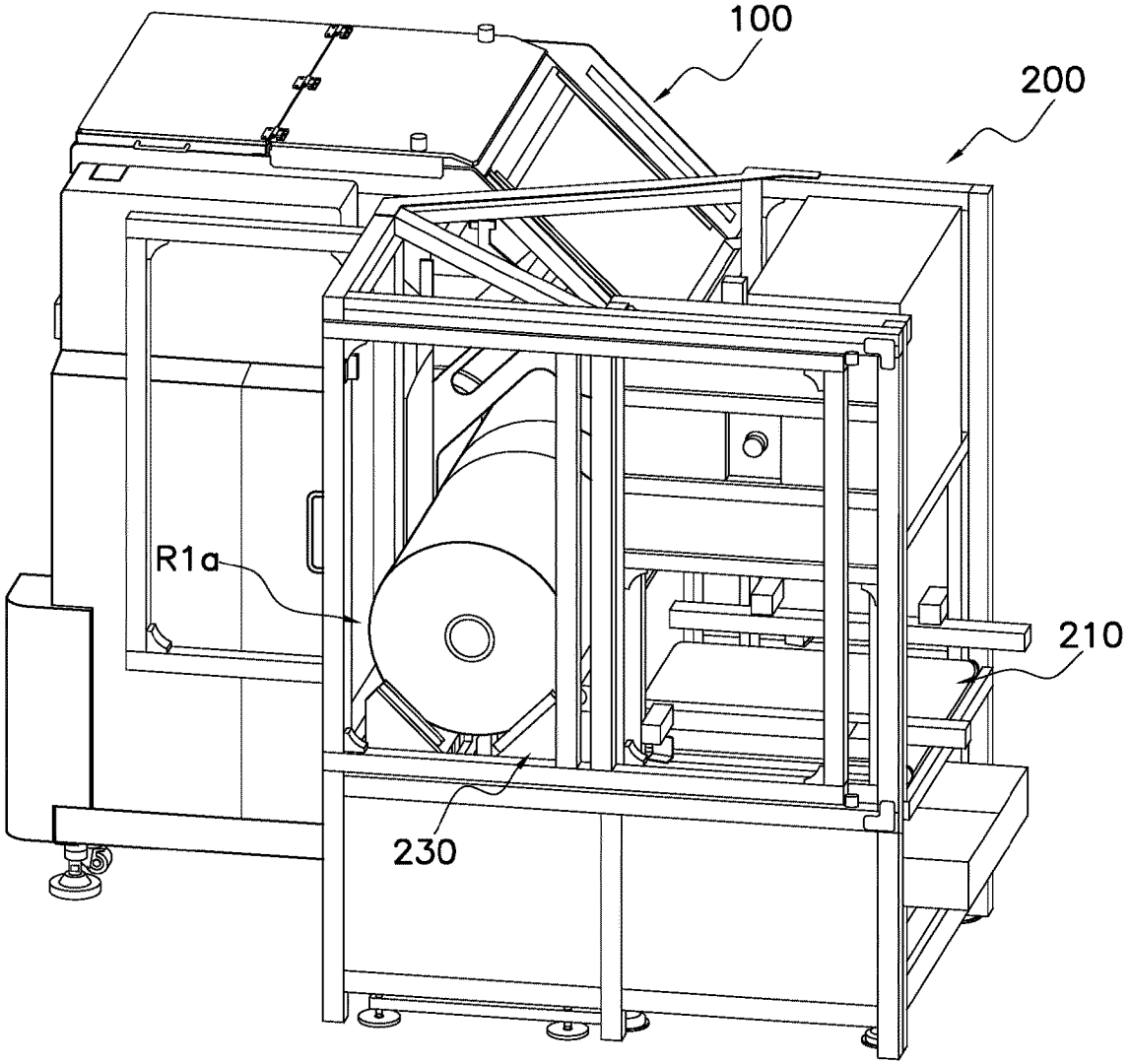
FIG. 4 is a schematic perspective view of the film supply section of the bag making and packaging machine of FIG. 1 and the film roll replacement device according to one embodiment of the claimed invention, as seen from the right rear.
Figure 4:
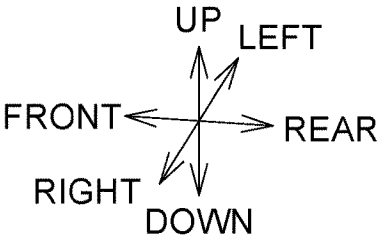
Figure 5:
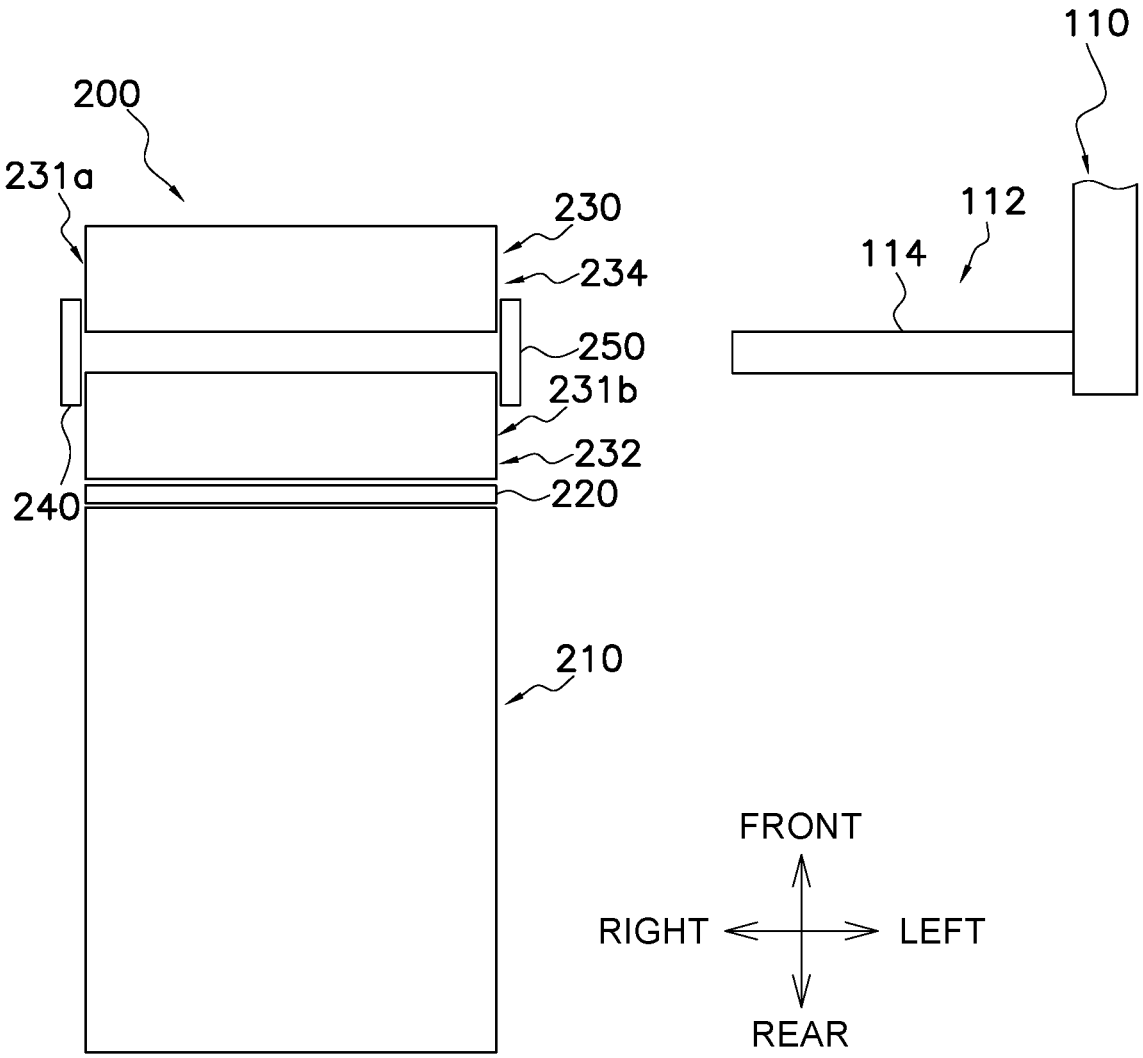
FIG. 5 is a schematic plan view of the film roll replacement device.
Figure 6:
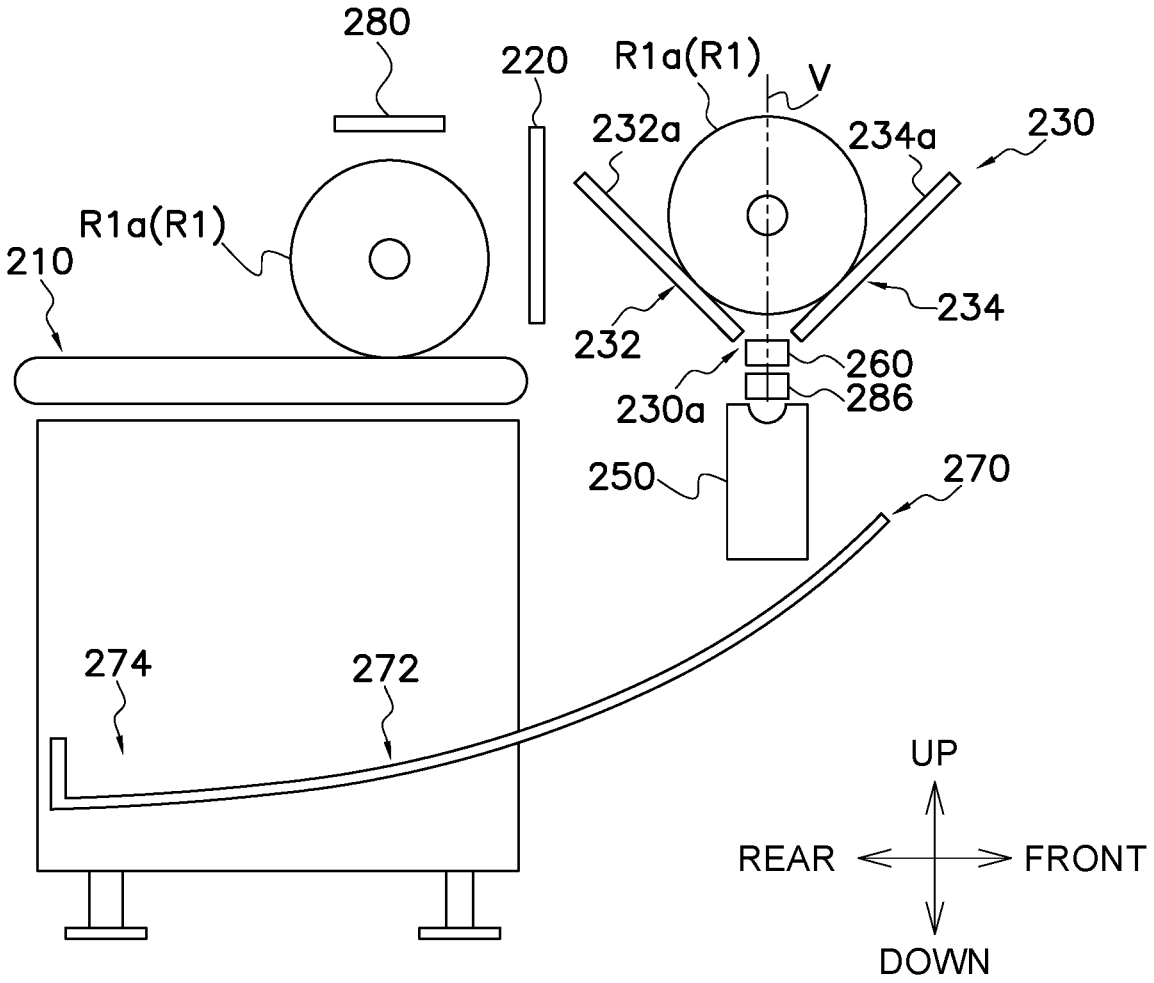
FIG. 6 is a schematic left-side view of the film roll replacement device.
Figure 8:
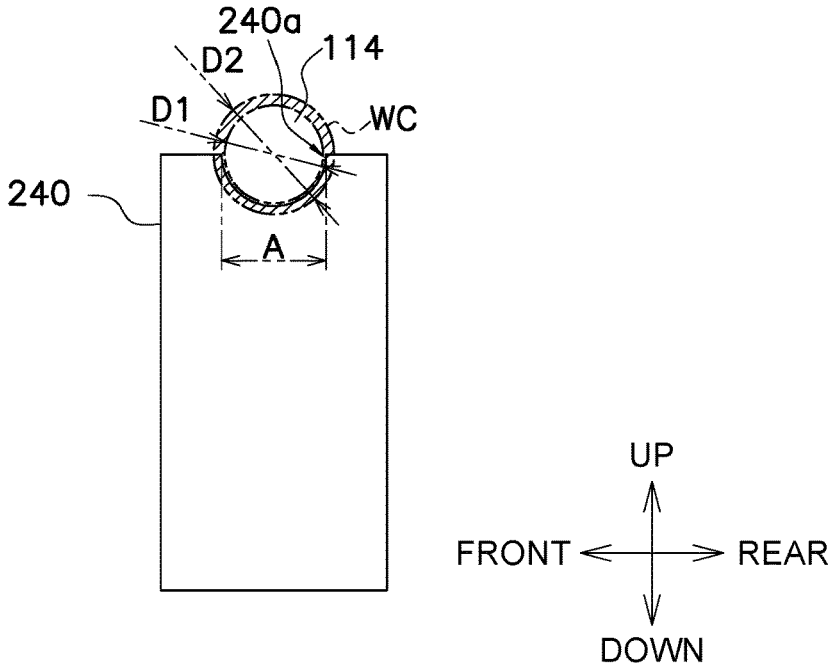
FIG. 8 is a schematic right-side view of a right-side pushing member of the film roll replacement device.
Figure 9:
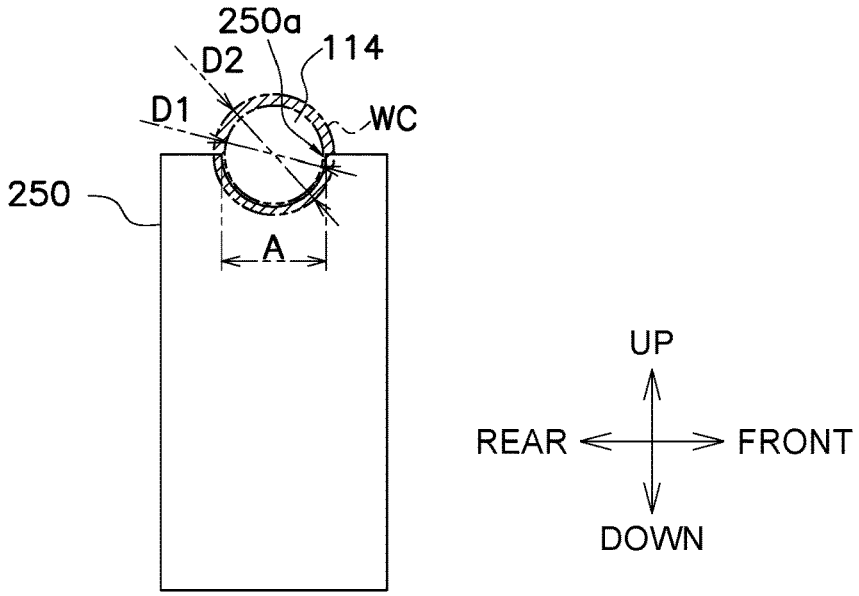
FIG. 9 is a schematic left-side view of a left-side pushing member of the film roll replacement device.

FIG. 3 is a schematic perspective view of the film supply section 100 of the bag making and packaging machine 3 and the film roll replacement device 200 as seen from the left rear. FIG. 4 is a schematic perspective view of the film supply section 100 of the bag making and packaging machine 3 and the film roll replacement device 200 as seen from the right rear. FIG. 5 is a schematic plan view of the film roll replacement device 200. FIG. 6 is a schematic left-side view of the film roll replacement device 200. A control block diagram of the film roll replacement device 200 is shown in the upper part of FIG. 7. FIG. 8 is a schematic right-side view of a right-side pushing member 240 of the film roll replacement device 200. FIG. 9 is a schematic left-side view of a left-side pushing member 250 of the film roll replacement device 200.

The film roll replacement device 200 supplies film rolls R1 to the bag making and packaging machine 3. For the sake of clarity in the description below, a film roll R1 supplied by the film roll replacement device 200 to the bag making and packaging machine 3 may be referred to as a first film roll R1*a*.

In the present disclosure, the film roll replacement device 200 removes a depleted film roll R1 or a partially used film roll R1 from a supporting shaft 114 of the bag making and packaging machine 3. The term "depleted film roll R1" means a film roll R1 in which the film F wound around the winding core WC has been used up (the remaining amount of the film F has become equal to or less than a predetermined amount). The term "partially used film roll R1" means a film roll R1 that is no longer used in the bag making and packaging machine 3 at least temporarily even though the film F has not been used up. For the sake of clarity in explanation below, a film roll R1 removed from the supporting shaft 114 of the bag making and packaging machine 3 may be referred to as a second film roll R1*b*.

The film roll replacement device 200 may be a device that has only the function of supplying film rolls R1 to the bag making and packaging machine 3. In this case, the second film roll R1*b* may be manually removed from the supporting shaft 114 by a worker.

The film roll replacement device 200 may be placed, for example, on the right side of the film supply section 100 of the bag making and packaging machine 3, as in FIGS. 3 and 4. The placement of the film roll replacement device 200 depicted in FIGS. 3 and 4 is merely one example, and may be changed as appropriate in accordance with the specifications of the bag making and packaging machine 3 and the film roll replacement device 200.

The film roll replacement device 200 has a conveyor 210, a gate 220, a holding section 230, a right-side pushing member 240, a left-side pushing member 250, a stopper 260, a winding-core-retrieving mechanism 270, and a first member 280, as shown in FIGS. 5 and 6. In addition, the film roll replacement device 200 has a gate-driving unit 222, a first driving unit 235, a second driving unit 236, a third driving unit 237, a right-side pushing-member-driving unit 242, a left-side pushing-member-driving unit 252, a stopper-driving unit 262, a first-member-driving unit 282, an encoder 284, a distance sensor 286, and a controller 290 as shown in FIG. 7. The driving units 222, 235, 236, 237, 242, 252, 262, 282 are motors, air cylinders, and other machines for actuating objects to be driven. The types of machines to use for the driving units 222, 235, 236, 237, 242, 252, 262, 282 may be selected as appropriate.

(2-2) Details (2-2-1) Holding Section

The holding section 230 is, at least temporarily, placed adjacent to a supporting shaft 114 supporting a film roll R1 in the bag making and packaging machine 3, as shown in FIG. Specifically, the holding section 230 is placed in a position adjacent to the previously described supporting shaft 114 caused to move to the film roll replacement device.

The holding section 230 holds the first film roll R1*a* supplied to the bag making and packaging machine 3. The holding section 230 also holds the second film roll R1*b* removed from the supporting shaft 114.

The holding section 230 has a first end portion 231*a* placed, in the left-right direction, on a far side of the supporting shaft 114 placed in the film roll replacement position, and a second end portion 231*b* placed on the side opposite to the first end portion 231*a*, on a side near the supporting shaft 114 placed in the film roll replacement position, as shown in FIG. 5. The holding section 230 holds the first film roll R1*a* supplied by the conveyor 210 and the second film roll R1*b* removed from the supporting shaft 114 between the first end portion 231*a* and the second end portion 231*b*, in an orientation such that the winding core WC extends in the left-right direction.

The holding section 230 has a first holding member 232 and a second holding member 234 as shown in FIGS. 5 and 6. The first holding member 232 and the second holding member 234 are arranged side by side in the front-rear direction. Specifically, the first holding member 232 is located behind the second holding member 234 (on the conveyor 210 side) as shown in FIGS. 5 and 6. The first holding member 232 and the second holding member 234 are flat members. However, the first holding member 232 and the second holding member 234 are not limited to being flat as long as the holding section 230 can function as described below. The first holding member 232 has a first holding surface 232*a* that supports the first film roll R1*a*, and the second holding member 234 has a second holding surface 234*a* that supports the first film roll R1*a*.

The flat-plate-form first holding member 232 and second holding member 234 are arranged so as to form a V shape in a right-side view, as in FIG. 6. In other words, the first holding member 232 and the second holding member 234 are arranged such that, in a right-side view and a left-side view, the first holding surface 232*a* and the second holding surface 234*a* form a V shape. In yet other words, the first holding member 232 and the second holding member 234 are arranged such that in a view along the axial directions of the supporting shafts 114 of the bag making and packaging machine 3, the first holding surface 232*a* and the second holding surface 234*a* form a V shape. In particular, a line perpendicular to the first holding surface 232*a* and a line perpendicular to the second holding surface 234*a* are orthogonal in this embodiment. However, the line perpendicular to the first holding surface 232*a* and the line perpendicular to the second holding surface 234*a* may form an angle other than 90°.

The first holding member 232 and the second holding member 234 arranged so as to form a V shape are spaced apart such that a gap 230*a* is formed between the first holding member 232 and the second holding member 234 in the trough of the V shape. In other words, the gap 230*a* is formed in a lower part of the holding section 230. A front-rear-directional width of the gap 230*a* is greater than an outer diameter of the winding cores WC of the film rolls R1. The gap 230*a* in the holding section 230 is used to allow passage of the winding core WC of the second film roll R1*b*, particularly the depleted film roll R1, which has been removed from the supporting shaft 114 and moved to the holding section 230, and to drop and discharge the winding core WC of the depleted film roll R1 into the winding-core-retrieving mechanism 270.

The holding section 230 is driven by the first driving unit 235, the second driving unit 236, and the third driving unit 237.

The first driving unit 235 causes the holding section 230 to rotate about a rotation axis that extends in the left-right direction and that is disposed in a predetermined position.

The second driving unit 236 moves the holding section 230 in the up-down direction.

The third driving unit 237 moves the holding section 230 in the left-right direction. In other words, the third driving unit 237 moves the holding section 230 in the second orientation to the left so as to approach the supporting shaft 114 located in the film roll replacement position, and to the right so as to move away from the supporting shaft 114 located in the film roll replacement position.

The third driving unit 237 of the present embodiment moves the holding section 230, the right-side pushing member 240, and the left-side pushing member 250 simultaneously to the left and right. In other words, the third driving unit 237 moves the holding section 230 integrally with the right-side pushing member 240 and the left-side pushing member 250 to the left and right.

(2-2-2) Right-Side Pushing Member

The right-side pushing member 240 is a member placed adjacent to the first end portion 231*a* of the holding section 230, as shown in FIG. 5. The right-side pushing member 240 is a member that pushes a right end surface of the first film roll R1*a* held by the holding section 230.

The right-side pushing member 240 is driven in the up-down direction by the right-side pushing-member-driving unit 242. By driving the right-side pushing member 240 in the up-down direction, the right-side pushing-member-driving unit 242 moves the right-side pushing member 240 to a position (referred to as a contact position) where the member can come into contact with an end surface of the first film roll R1*a*. In addition, by driving the right-side pushing member 240 in the up-down direction, the right-side pushing-member-driving unit 242 moves the right-side pushing member 240 to a position (referred to as a non-contact position) where the member does not come into contact with the film rolls R1 mounted on the supporting shafts 114 of the bag making and packaging machine 3.

Furthermore, the right-side pushing member 240 is driven in the left-right direction by the third driving unit 237. In particular, while the right-side pushing member 240 being in the contact position, the third driving unit 237 moves the right-side pushing member 240 to the left so that the right end surface of the first film roll R1*a* held by the holding section 230 is pushed by the right-side pushing member 240, and the first film roll R1*a* is moved leftward toward the supporting shaft 114 located in the film roll replacement position.

There are no particular limitations as to the shape of the right-side pushing member 240; the member has a substantially rectangular shape in a right-side view as in FIG. 8. In an upper part of the right-side pushing member 240 there is preferably formed a recess 240*a* that conforms to a shape of an outer diameter of the supporting shafts 114 of the bag making and packaging machine 3. There are no particular limitations as to the shape; the recess 240*a* is, for example, U-shaped or V-shaped. For example, if the recess 240*a* is U-shaped, the recess 240*a* is substantial rectangular and a lower end part thereof is formed in a semicircular shape in a right-side view. Moreover, if the recess 240*a* is U-shaped, the recess 240*a* may be a semicircular recess in a right-side view as shown in FIG. 8. In the present disclosure, a semicircular recess 240*a* is formed in an upper part of the right-side pushing member 240. Preferably, a diameter A of the semicircle of the recess 240*a* is greater than a diameter D1 of the supporting shaft 114 on which the first film roll R1*a* is mounted, and is less than a diameter D2 of an outer circumference of the winding core WC of the first film roll R1*a*.

(2-2-3) Left-Side Pushing Member

The left-side pushing member 250 is a member located adjacent to the second end portion 231*b* of the holding section 230 as shown in FIG. 5. The left-side pushing member 250 is a member that pushes the right end surface of the first film roll R1*a* mounted on a supporting shaft 114 of the bag making and packaging machine 3. In addition, the left-side pushing member 250 is a member that pushes a left end surface of the second film roll R1*b* removed from a supporting shaft 114 of the bag making and packaging machine 3.

The left-side pushing member 250 is driven in the up-down direction by the left-side pushing-member-driving unit 252. By driving the left-side pushing member 250 in the up-down direction, the left-side pushing-member-driving unit 252 moves the left-side pushing member 250 to a position (referred to as a contact position) where the member can come into contact with the end surface of the first film roll R1*a* and the end surface of the second film roll R1*b*. In addition, by driving the left-side pushing member 250 in the up-down direction, the left-side pushing-member-driving unit 252 moves the left-side pushing member 250 to a position (referred to as a non-contact position) where the member does not come into contact with the film rolls R1 mounted on the supporting shafts 114 of the bag making and packaging machine 3.

Furthermore, the left-side pushing member 250 is driven in the left-right direction by the third driving unit 237.

With the left-side pushing member 250 in the contact position and the left-side pushing member 250 located on the right side of the first film roll R1*a*, the third driving unit 237 moves the left-side pushing member 250 to the left. At this time, the left-side pushing member 250 pushes the right end surface of the first film roll R1*a* in which the supporting shaft 114 is inserted into part of a hollow part of the winding core WC, and moves the first film roll R1*a* leftward to a predetermined position on the supporting shaft 114.

In addition, with the left-side pushing member 250 in the contact position and the left-side pushing member 250 located on the left side of the second film roll R1*b*, the third driving unit 237 moves the left-side pushing member 250 to the right. At this time, the left-side pushing member 250 pushes the left end surface of the second film roll R1*b* in which the supporting shaft 114 is supported, and moves the second film roll R1*b* to the holding section 230.

There are no particular limitations as to the shape of the left-side pushing member 250; the member is substantially rectangular in a left-side view as in FIG. 9. In an upper part of the left-side pushing member 250 is formed a recess 250*a* having the same shape as the recess 240*a* of the right-side pushing member 240. Because the shape of the recess 250*a* is the same as the shape of the recess 240*a*, details of the shape of the recess 250*a* shall not be described. Due to the recess 250*a* being formed in the upper part of the left-side pushing member 250, the left-side pushing member 250 can push the winding core WC of the first film roll R1*a* and the winding core WC of the second film roll R1*b*.

(2-2-4) Stopper

The stopper 260 is a member for closing the gap 230*a* in the holding section 230 in the second orientation (see FIG. 6) and preventing the second film roll R1*b* removed from the supporting shaft 114 from falling from the gap 230*a* into the winding-core-retrieving mechanism 270 below.

(2-2-5) Winding-Core-Retrieving Mechanism

The winding-core-retrieving mechanism 270 is a mechanism that retrieves the second film roll R1*b* removed from the supporting shaft 114 and fallen from the gap 230*a* in the holding section 230 in the second orientation. Particularly, the winding-core-retrieving mechanism 270 is a mechanism for retrieving the winding core WC of a depleted film roll R1 serving as the second film roll R1*b* falling from the gap 230*a* in the holding section 230 in the second orientation.

The second film roll R1*b* fallen from the gap 230*a* in the holding section 230 slides down an inclined surface 272 of the winding-core-retrieving mechanism 270 and is retrieved in a retrieval area 274 directly below the conveyor 210 (see FIG. 6). The manner of retrieving the second film roll R1*b* fallen from the gap 230*a* in the holding section 230 may be designed as appropriate.

(2-2-6) First Member and Encoder

The first member 280 and the encoder 284 are components used to measure a diameter of the first film roll R1*a* supplied to the bag making and packaging machine 3.

The first member 280 is located above the conveyor 210.

The first member 280 is located in a predetermined first position (standby position) when not being used to measure the diameter of the first film roll R1*a*. The first position is a position at which the first member 280 does not come into contact with the first film roll R1*a* conveyed along the conveyor 210, even if the first member 280 had been present in the first position. When the first member 280 is used to measure the diameter of the first film roll R1*a*, the first-member-driving unit 282 downwardly moves the first member 280 to a second position where contact is made with an outer peripheral surface (upper end) of the first film roll R1*a* carried on the conveyor 210.

The first-member-driving unit 282 in this embodiment is a motor to which the encoder 284 is attached. The encoder 284 measures an amount of rotational displacement of the motor when the first-member-driving unit 282 moves the first member 280 from the first position to the second position, and transmits to the controller 290 (described hereinafter) a signal corresponding to the measured amount of rotational displacement.

The controller 290, serving as a first measuring unit, calculates a distance the first member 280 moves from the first position to the second position based on the signal of the encoder 284. Furthermore, the controller 290 measures the diameter of the first film roll R1*a* on the conveyor 210 based on the calculated distance that the first member 280 moves.

(2-2-7) Distance Sensor

The distance sensor 286 is a sensor that contactlessly measures a distance from a predetermined reference position to the outer peripheral surface of the film roll R1. For example, the distance sensor 286 is located directly below the gap 230*a* in the holding section 230. There are no limitations as to the type of the distance sensor 286; for example, the distance sensor 286 is a laser distance sensor. The distance sensor 286 can measure a distance from a reference position where the distance sensor 286 is located to the outer peripheral surface of the film roll R1 carried on the holding section 230, or to the outer peripheral surface of the film roll R1 mounted on the supporting shaft 114.

(2-2-8) Controller

The controller 290 is a device that controls the actions of the components of the film roll replacement device 200. The controller 290 has, for example, a CPU, storage devices such as a main storage device and an auxiliary storage device, an input/output device, and various electric circuits and electronic circuits.

Figure 7:
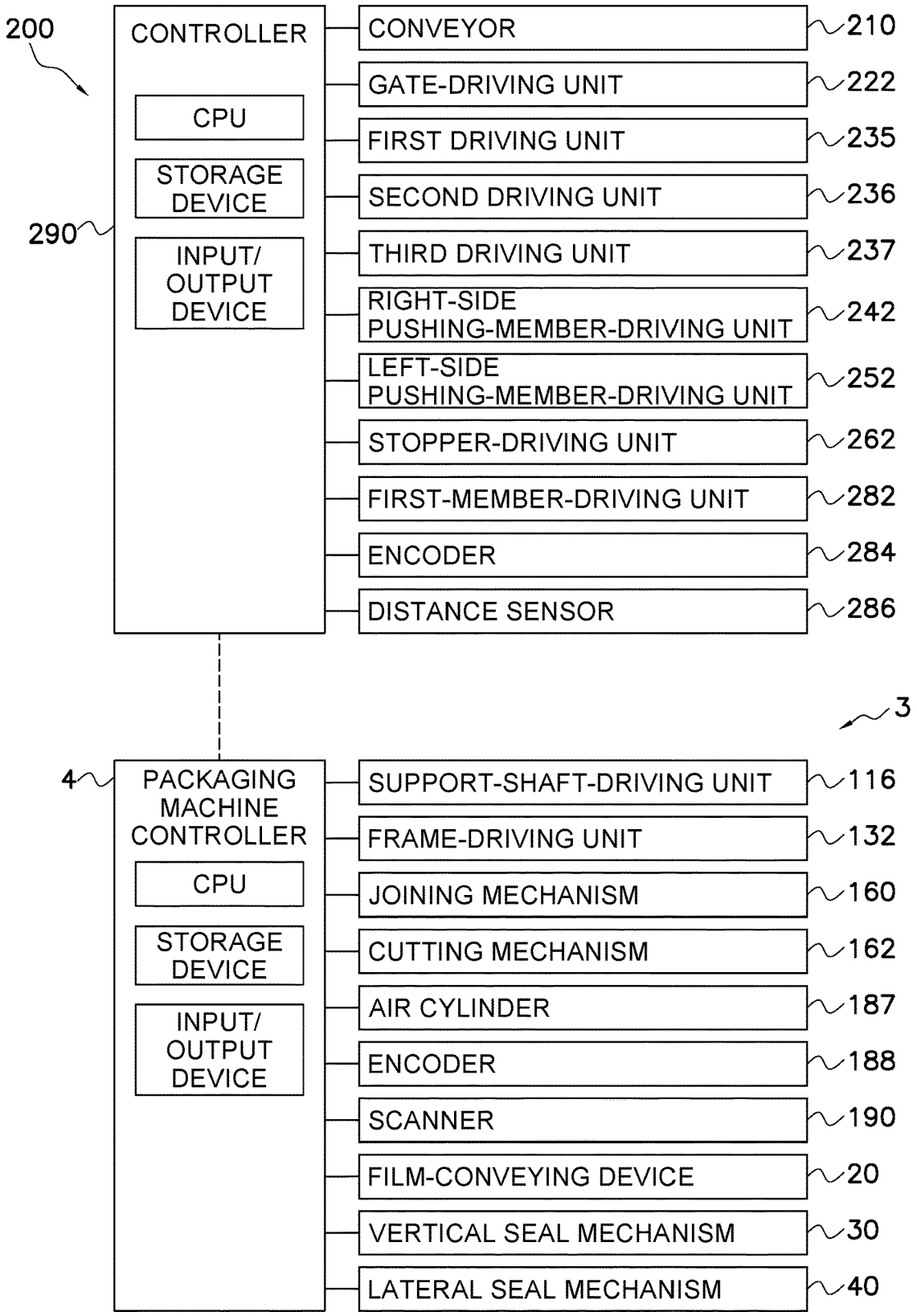
FIG. 7 is a control block diagram of the bag making and packaging machine and the film roll replacement device.

The controller 290 is electrically connected to the conveyor 210, the gate-driving unit 222, the first driving unit 235, the second driving unit 236, the third driving unit 237, the right-side pushing-member-driving unit 242, the left-side pushing-member-driving unit 252, the stopper-driving unit 262, the first-member-driving unit 282, and the encoder 284, as shown in FIG. 7. The controller 290 controls actions of the conveyor 210, the gate-driving unit 222, the first driving unit 235, the second driving unit 236, the third driving unit 237, the right-side pushing-member-driving unit 242, the left-side pushing-member-driving unit 252, the stopper-driving unit 262, and the first-member-driving unit 282. In addition, the controller 290 receives signals output by the encoder 284 and the distance sensor 286. In addition, the controller 290 is communicably connected to the packaging machine controller 4 of the bag making and packaging machine 3.

Below is a description, made with reference to FIGS. 10 to 13, of the manner in which the film roll replacement device 200 removes the second film roll R1*b* from the supporting shaft 114 and mounts the replacement first film roll R1*a* on the supporting shaft 114. FIGS. 10A to 10E are schematic plan views of part of the film roll replacement device 200, and illustrate the actions of the film roll replacement device 200 when the second film roll R1*b* is removed from the supporting shaft 114 of the bag making and packaging machine 3. FIG. 11 is a schematic left-side view illustrating the actions of the film roll replacement device 200 when the second film roll R1*b* is removed from the supporting shaft 114 of the bag making and packaging machine 3. FIGS. 12A to 12E are schematic left-side views of part of the film roll replacement device 200 and illustrate movement of the first film roll R1*a* to the holding section 230 and adjustment of a height position of the holding section 230. FIGS. 13A to 13E are schematic plan views of part of the film roll replacement device 200 and illustrate the mounting of the first film roll R1*a* on the supporting shaft 114 of the bag making and packaging machine 3 by the film roll replacement device 200.

(A) Removal of Second Film Roll from Supporting Shaft of Bag Making and Packaging Machine When a request to replace a film roll R1 is transmitted from the packaging machine controller 4, the controller 290 first removes the film roll R1 (second film roll R1*b*) from the supporting shaft 114 of the bag making and packaging machine 3.

Though not an action of the film roll replacement device 200, the action of the bag making and packaging machine 3 when the packaging machine controller 4 transmits a request to replace a film roll R1 shall first be described. Particularly, the action of the bag making and packaging machine 3 shall now be described regarding when the film F is used up from the film roll R1 that had so far been used in the bag making and packaging machine 3.

The packaging machine controller 4 senses that the film F of the film roll R1 used so far has been used up based on, for example, movement of the movable rollers 185 detected based on a signal output by the encoder 188. Upon sensing that the film F of the film roll R1 has been used up, the packaging machine controller 4 controls the joining mechanism 160 to join the vicinity of the trailing end of the film F of the depleted film roll R1 and the vicinity of the leading end of the film F of the replacement film roll R1. The packaging machine controller 4 also controls the cutting mechanism 162 to cut the film F of the depleted film roll R1 at a predetermined position.

The packaging machine controller 4 then drives the frame-driving unit 132 to move the supporting shaft 114 supporting the replaced film roll R1 (the film roll R1 to be used for packaging from this point onward) to the film supply position and move the supporting shaft 114 supporting the depleted film roll R1 to the film roll replacement position.

Now, description of the removal of the second film roll R1*b* from the supporting shaft 114 disposed in the film roll replacement position performed by the film roll replacement device 200 is made, with reference to FIGS. 10A to 10D and FIG. 11. The following description is merely one example of the action of removing the second film roll R1*b* performed by the film roll replacement device 200, and may be changed as appropriate.

When the controller 290 receives a request to replace the film roll R1 from the packaging machine controller 4, the controller 290 controls the action of the third driving unit 237 to move the holding section 230 from the position depicted in FIG. 10A, which is adjacent to the gate 220, leftward to a position directly below the supporting shaft 114 disposed in the film roll replacement position of FIG. 10B.

Figure 10A:
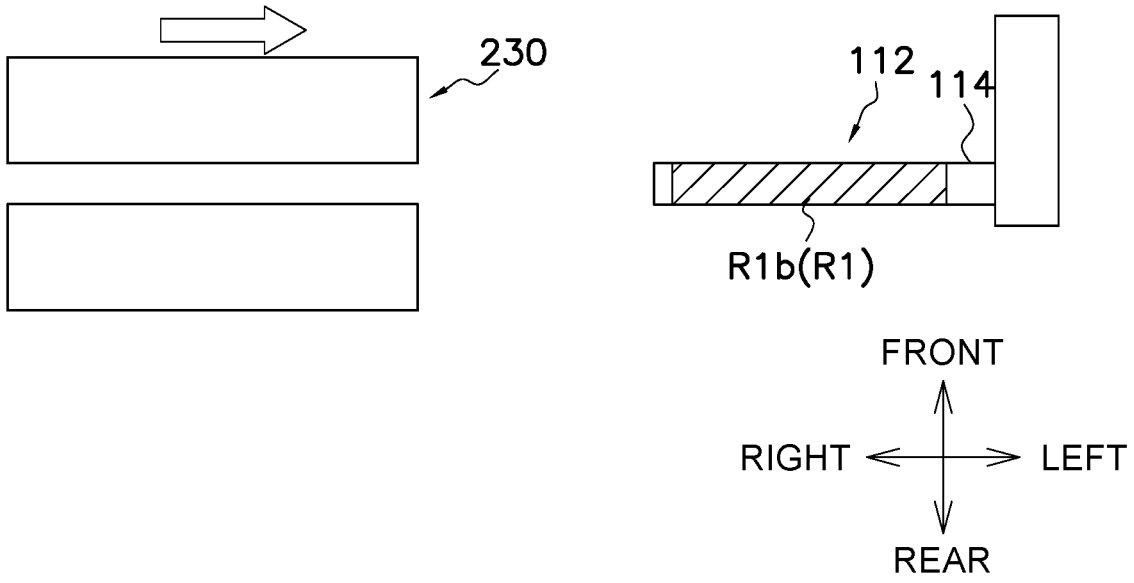
FIG. 10A is a schematic plan view of part of the film roll replacement device and illustrates an action of the film roll replacement device when a film roll is removed from a supporting shaft of the bag making and packaging machine.
Figure 10B:
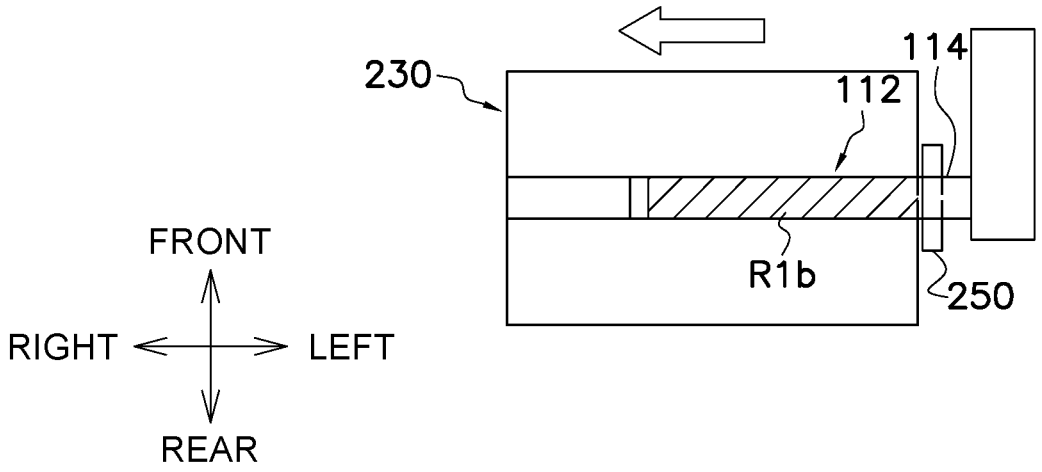
FIG. 10B is a schematic plan view of part of the film roll replacement device and illustrates the action of the film roll replacement device when the film roll is removed from the supporting shaft of the bag making and packaging machine.
Figure 10C:
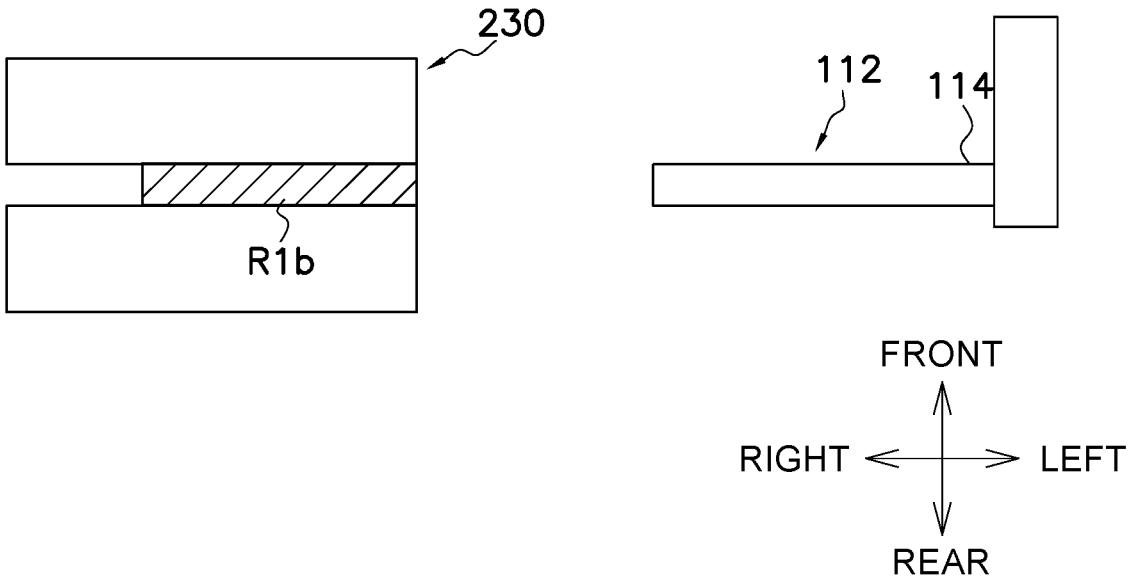
FIG. 10C is a schematic plan view of part of the film roll replacement device and illustrates the action of the film roll replacement device when the film roll is removed from the supporting shaft of the bag making and packaging machine.
Figure 10D:
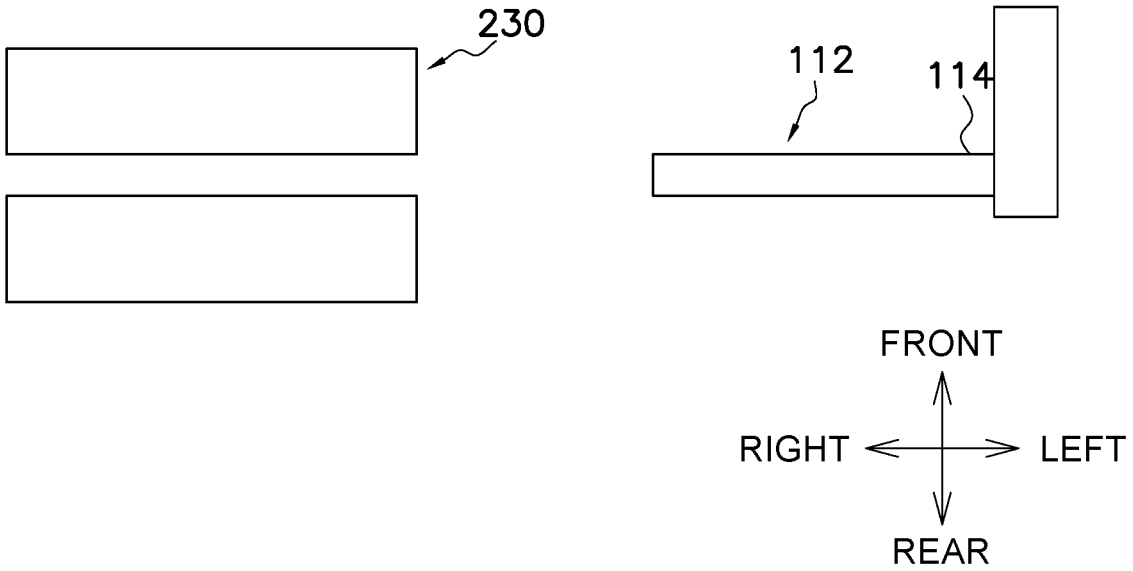
FIG. 10D is a schematic plan view of part of the film roll replacement device and describes the action of the film roll replacement device when the film roll is removed from the supporting shaft of the bag making and packaging machine.
Figure 11:
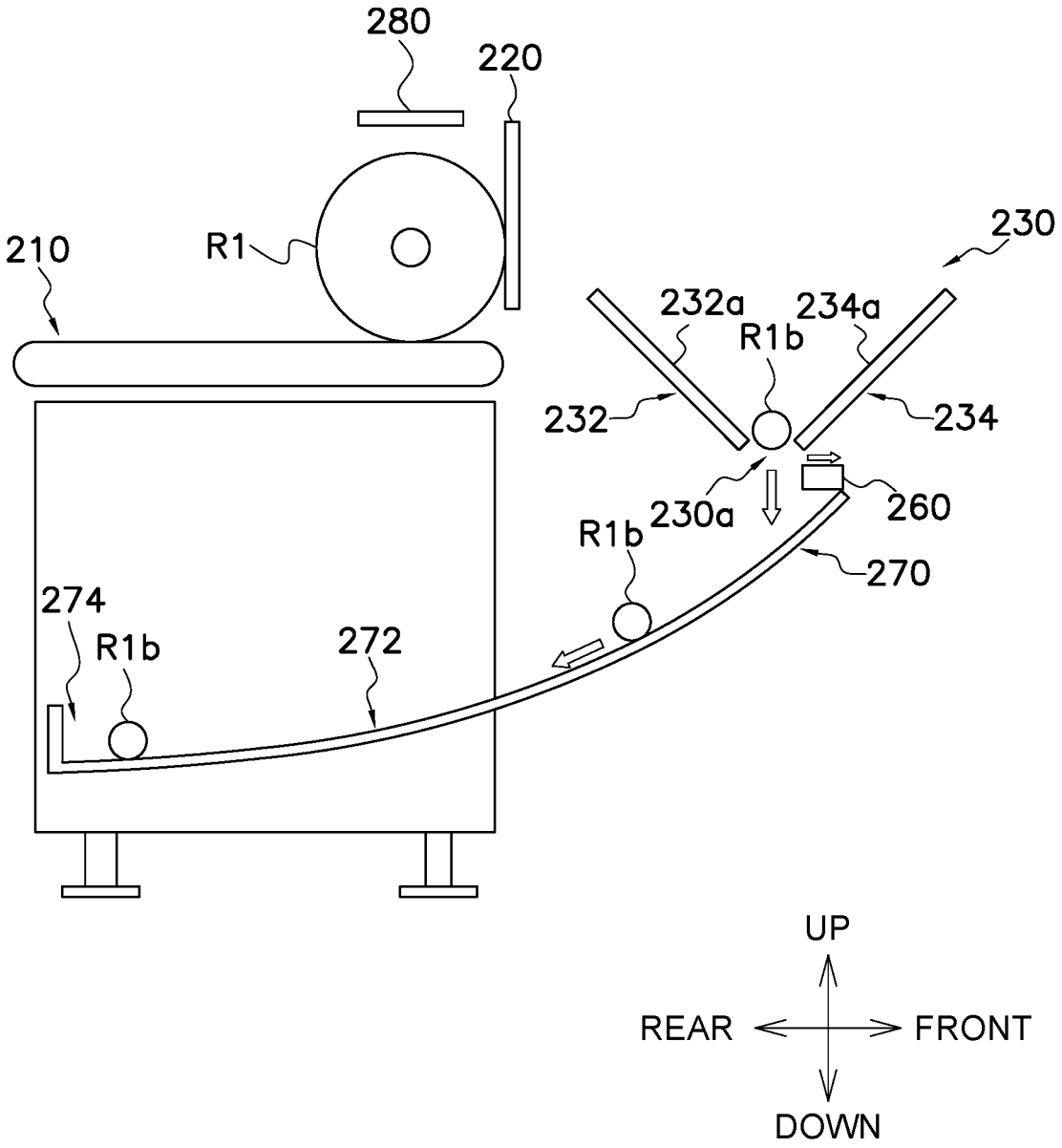
FIG. 11 is a schematic left-side view illustrating the action of the film roll replacement device when a winding core of a depleted film roll is retrieved from a supporting shaft of the bag making and packaging machine.

Next, the controller 290 controls the action of the third driving unit 237 and moves the holding section 230 rightward from the position depicted in FIG. 10B to the position in FIG. 10C (the position where the holding section 230 is located at the point in time of FIG. 10A). Through this process, the second film roll R1*b* is pushed and moved by the left-side pushing member 250 onto the holding section 230 as is depicted in FIG. 10C.

Next, the controller 290 causes the stopper 260 to be moved to the open position by the stopper-driving unit 262. As a result, the second film roll R1*b* (the winding core WC of the second film roll R1*b*) falls from the gap 230*a* in the holding section 230 (see FIG. 10D). The detection result from the distance sensor 286 can be used to determine whether or not the second film roll R1*b* has fallen safely.

When the controller 290 has caused the stopper 260 to be moved by the stopper-driving unit 262 to the open position, the second film roll R1*b*, after falling from the gap 230*a* in the holding section 230, slides down the inclined surface 272 of the winding-core-retrieving mechanism 270 to be retrieved in the retrieval area 274 located directly below the conveyor 210, as shown in FIG. 11.

(B) Mounting of First Film Roll on Supporting Shaft of Bag Making and Packaging Machine When removal of the second film roll R1*b* from the supporting shaft 114 of the bag making and packaging machine 3 is complete, the controller 290 supplies the first film roll R1*a* to the bag making and packaging machine 3 and mounts the first film roll R1*a* on the supporting shaft 114.

The movement of the first film roll R1*a* to the holding section 230 and the adjustment of the height position of the holding section 230 shall first be described with reference to FIGS. 12A to 12E. The mounting of the first film roll R1*a* onto the supporting shaft 114 of the bag making and packaging machine 3, performed by the film roll replacement device 200, shall then be described with reference to FIGS. 13A to 13E.

Figure 12A:
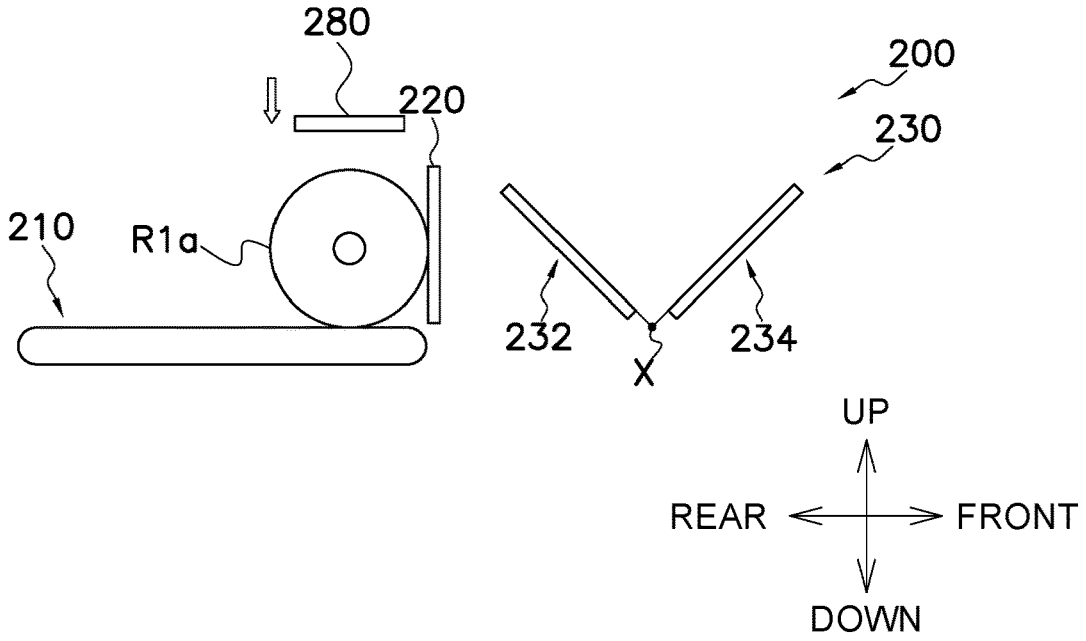
FIG. 12A is a schematic left-side view of part of the film roll replacement device and illustrates movement of a film roll to the holding section and adjustment of a height position of the holding section.

(B-1) Movement of First Film Roll to Holding Section and Adjustment of Height Position of Holding Section It is presumed in the description below that at the point in time depicted in FIG. 12A, a film roll R1 is not present on the holding section 230, and the holding section 230, which is in the second orientation previously described, is located in a position (initial position) adjacent to the front of the gate 220. In addition, at the point in time depicted in FIG. 12A, the gate 220 is in a position where the first film roll R1*a* is restricted from moving toward the holding section 230, and the first film roll R1*a* is being carried on the conveyor 210 in a position adjacent to the gate 220. The first member 280 is located in the above-described first position where the first member 280 is apart from the first film roll R1*a* and above the first film roll R1*a*.

Figure 12B:
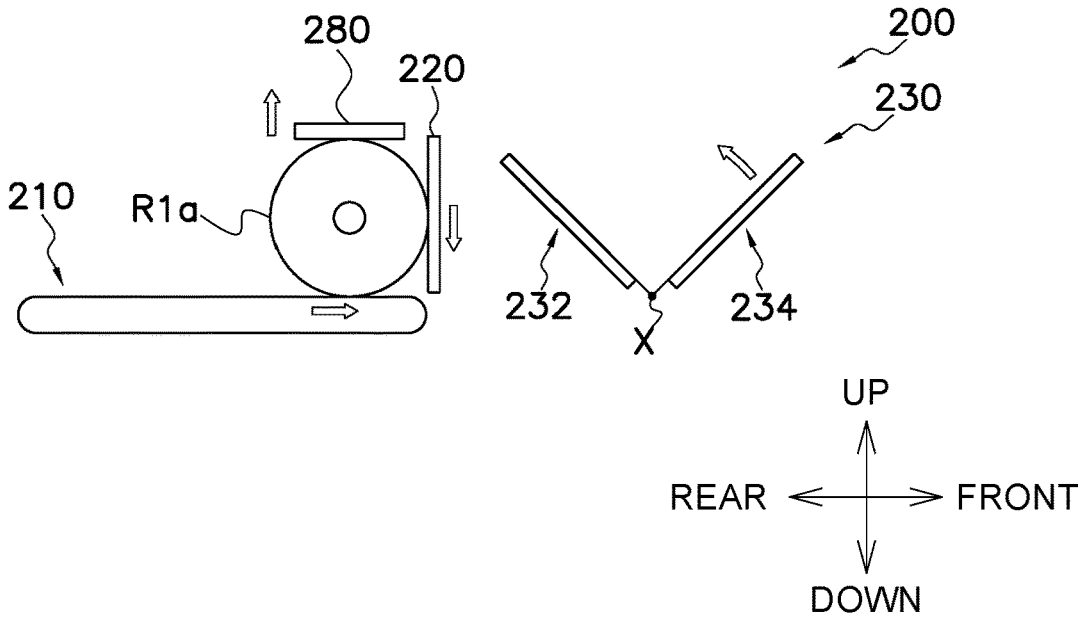
FIG. 12B is a schematic left-side view of part of the film roll replacement device and illustrates the movement of the film roll to the holding section and the adjustment of the height position of the holding section.

In this state, the controller 290 causes the first-member-driving unit 282 to move the first member 280 to a second position where contact is made with the outer peripheral surface (upper end) of the first film roll R1*a* carried on the conveyor 210 (see FIG. 12B).

When the first-member-driving unit 282 has moved the first member 280 from the first position to the second position, the controller 290 receives a signal, sent by the encoder 284, corresponding to an amount of rotational displacement of a motor (the first-member-driving unit 282). The controller 290 calculates the distance the first member 280 moves from the first position to the second position based on the signal of the encoder 284. Furthermore, the controller 290, serving as a first measuring unit, measures (calculates) the diameter of the first film roll R1*a* on the conveyor 210 based on the calculated movement distance of the first member 280. For example, a distance from the first position to a conveying surface (the surface on which the first film roll R1*a* is carried) of the conveyor 210 is stored in advance in a storage device of the controller 290. The controller 290 calculates the diameter of the first film roll R1*a* by subtracting the distance the first member 280 moves from the first position to the second position, from the distance from the first position to the conveying surface of the conveyor 210.

Next, the controller 290 causes the first-member-driving unit 282 to move the first member 280 to the first position where contact is not made with the outer peripheral surface of the first film roll R1*a*.

Next, the controller 290 controls the action of the first driving unit 235 to cause the holding section 230 to rotate and change the orientation of the holding section 230 from the second orientation to the first orientation. Particularly, in the present embodiment, when the holding section 230 is in the first orientation, the first holding surface 232*a* is horizontal. The controller 290 controls the action of the first driving unit 235 to cause the holding section 230 to rotate 45° counterclockwise in a left-side view, and changes the orientation of the holding section 230 from the second orientation to the first orientation (see FIG. 12C). For example, if the holding section 230 on the first holding surface 232*a* slightly inclined so as to lower from rear to front is defined as the holding section 230 in the first orientation, the angle at which the controller 290 causes the holding section 230 to rotate may be determined, as appropriate, to be a predetermined angle other than 45°.

Figure 12C:
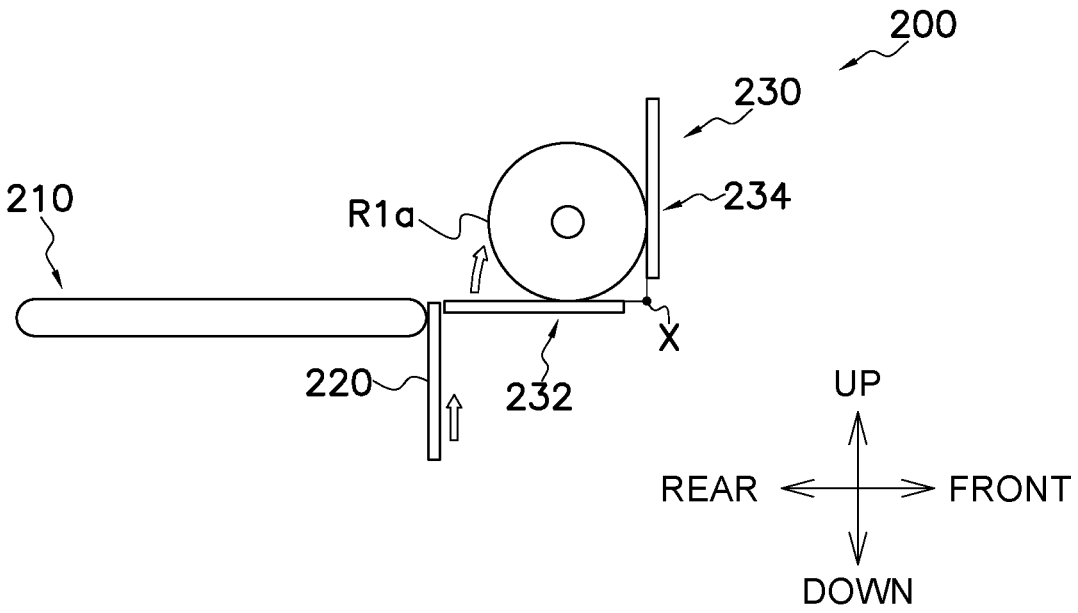
FIG. 12C is a schematic left-side view of part of the film roll replacement device and illustrates the movement of the film roll to the holding section and the adjustment of the height position of the holding section.

The controller 290 also controls the action of the gate-driving unit 222 to move the gate 220 to a position where the first film roll R1*a* is not restricted from moving toward the holding section 230 (see FIG. 12C). The controller 290 also controls the action of the conveyor 210 to move the first film roll R1*a* to the holding section 230 (see FIG. 12C).

The controller 290 then controls the action of the first driving unit 235 to cause the holding section 230 to rotate, and changes the orientation of the holding section 230 from the first orientation to the second orientation. Particularly, in the present embodiment, because the holding section 230 with the horizontal first holding surface 232*a* is the holding section 230 in the first orientation, the controller 290 controls the action of the first driving unit 235 to cause the holding section 230 to rotate 45° clockwise in a left-side view, and changes the orientation of the holding section 230 from the first orientation to the second orientation (see FIG. 12C). For example, if the holding section 230 on the first holding surface 232*a* slightly inclined so as to lower from rear to front is defined as the holding section 230 in the first orientation, the angle at which the controller 290 causes the holding section 230 to rotate may be determined, as appropriate, to be a predetermined angle other than 45°.

Figure 12D:
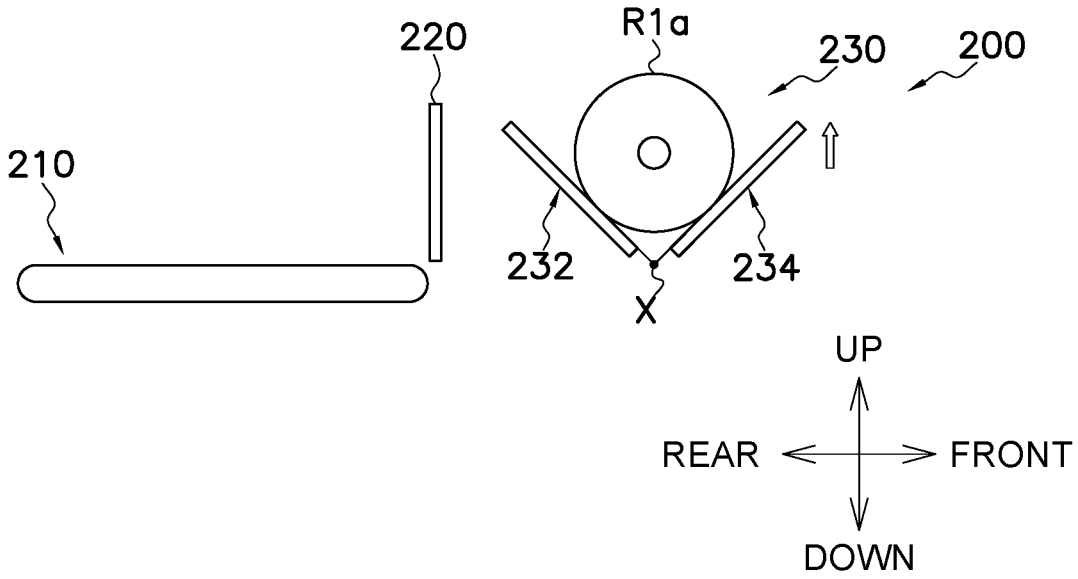
FIG. 12D is a schematic left-side view of part of the film roll replacement device and illustrates the movement of the film roll to the holding section and the adjustment of the height position of the holding section.

The controller 290 also controls the action of the gate-driving unit 222 to move the gate 220 to a position where the first film roll R1*a* is restricted from moving toward the holding section 230 (see FIG. 12D). The controller 290 also stops the action of the conveyor 210.

Next, based on the measured diameter of the first film roll R1*a*, the controller 290 controls the action of the second driving unit 236 to move the holding section 230 to a position where the height position of the center of the first film roll R1*a* held in the holding section 230 is aligned with the height of the center of the supporting shaft 114 disposed in the film roll replacement position.

Figure 14:
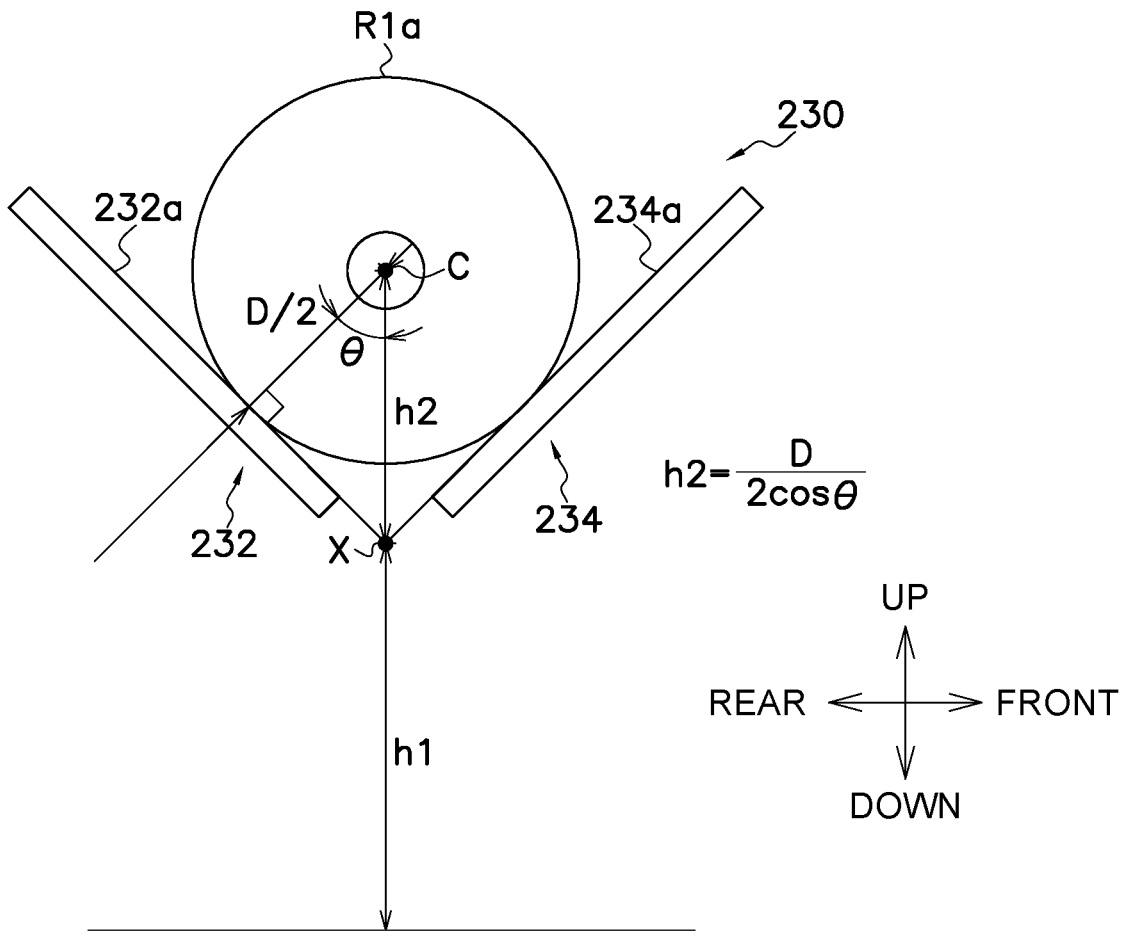
FIG. 14 is an enlarged view of the holding section of the film roll replacement device, and is a drawing illustrating a method of measuring the height position up to the center of the first film roll.

For example, specifically, the controller 290 changes the height position of the holding section 230 in the following manner. The description shall be made with reference to FIG. 14. FIG. 14 is an enlarged view of the holding section 230 of the film roll replacement device 200, and illustrates a method of measuring the height position to the center of the first film roll R1*a*.

It is presumed in the description below that the storage device of the controller 290 has stored therein information on the height position of the center of the supporting shaft 114 disposed in the film roll replacement position (e.g., a height H1 from a floor surface to the center of the supporting shaft 114). It is also presumed in the description below that the controller 290 ascertains, for example, a height position that is the current location of the intersection point X between a straight line imagined as an extension of the first holding surface 232*a* and a straight line imagined as an extension of the second holding surface 234*a* in a left-side view (e.g., a height h1 from the floor surface to the intersection point X).

Under such conditions, the controller 290 calculates in the following manner the height position of the center of the first film roll R1*a* currently held by the holding section 230. Because the height h1 from the floor surface to the intersection point X is known at present, the height from the floor surface to the center (represented by symbol C) of the first film roll R1*a* can be determined when the value of h2 is determined in FIG. 14. The controller 290 has calculated the diameter D of the first film roll R1*a* as previously described. In addition, in a left-side view, an angle θ formed between a straight line connecting the intersection point X and the center C and a line perpendicular to the first holding surface 232*a* is determined according to the design of the holding section 230 and is therefore known. Therefore, using a trigonometric function, h2 can be calculated by the formula $D/2 \cos \theta$. The controller 290 calculates the height position of the center of the first film roll R1*a* currently held by the holding section 230 by adding the value h1 and the value h2 together. When the height position of the center of the first film roll R1*a* currently held by the holding section 230 is calculated and the holding section 230 is moved upward by a distance of $\Delta h = H1 - (h1 + h2)$, the height position of the center of the first film roll R1*a* held by the holding section 230 will be aligned with the height position of the center of the supporting shaft 114 disposed in the film roll replacement position.

Figure 12E:
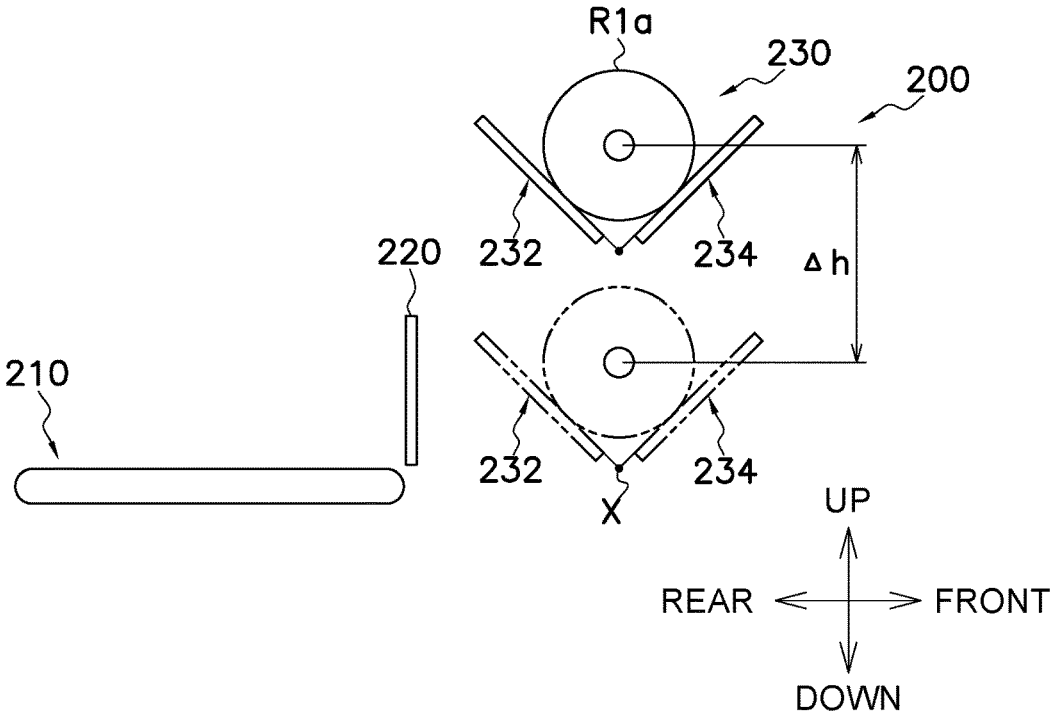
FIG. 12E is a schematic left-side view of part of the film roll replacement device and illustrates the movement of the film roll to the holding section and the adjustment of the height position of the holding section.

The controller 290 then controls the action of the second driving unit 236 to move the holding section 230 upward by a distance of Δh from the position drawn in double-dash lines to the position drawn in solid lines, as in FIG. 12E. As a result, the height position of the center of the first film roll R1*a* held by the holding section 230 is aligned with the height position of the center of the supporting shaft 114 disposed in the film roll replacement position. If the value of Δh is negative, the holding section 230 is caused to move downward.

Due to the structure of the holding section 230, the center C of the first film roll R1 held in the holding section 230 is disposed in the same position as the intersection point X previously described in the front-rear direction. In other words, in a left-side view, the center of the first film roll R1 held in the holding section 230 is disposed on a straight line extending in the vertical direction through the intersection point X. Therefore, if the film roll replacement device 200 is designed such that the front-rear-directional position of the intersection point X does not change, there is no need, in the front-rear direction, to adjust the position of the center of the first film roll R1*a* held in the holding section 230 and the position of the center of the supporting shaft 114 disposed in the film roll replacement position.

The film roll replacement device 200 preferably has, for example, both an electric cylinder and an air cylinder as the second driving unit 236. The reason therefor shall now be described.

Even, for example, using only an electric cylinder as the second driving unit 236, the film roll replacement device 200 can move the holding section 230 to a position where the height position of the center of the first film roll R1*a* held by the holding section 230 is aligned with the height of the center of the supporting shaft 114 disposed in the film roll replacement position. However, since the first film roll R1*a* is a heavy object, a large electric cylinder will be needed if the holding section 230 carrying the first film roll R1*a* is to be moved by an electric cylinder alone. Therefore, the film roll replacement device 200 preferably uses an air cylinder in addition to an electric cylinder.

As a specific control, for example, when moving the holding section 230, the controller 290 controls an electro-pneumatic regulator (not shown in the figure) to gradually increase an internal pressure of the air cylinder. When a slight movement of the holding section 230 (a movement of the first film roll R1*a* held in the holding section 230) is sensed using the distance sensor 286 or the like, the controller 290 controls the electric cylinder to bring the height position of the center of the first film roll R1*a* held in the holding section 230 into alignment with the height of the center of the supporting shaft 114 disposed in the film roll replacement position while pressure generated by the electro-pneumatic regulator (not shown in the figure) is kept constant.

(B-2) Mounting of First Film Roll onto Supporting Shaft of Bag Making and Packaging Machine The following is a description of how the first film roll R1*a* is mounted onto the supporting shaft 114 by the film roll replacement device 200 after the height position of the center of the first film roll R1*a* held by the holding section 230 and the height position of the center of the supporting shaft 114 disposed in the film roll replacement position have come into alignment.

Figure 13A:
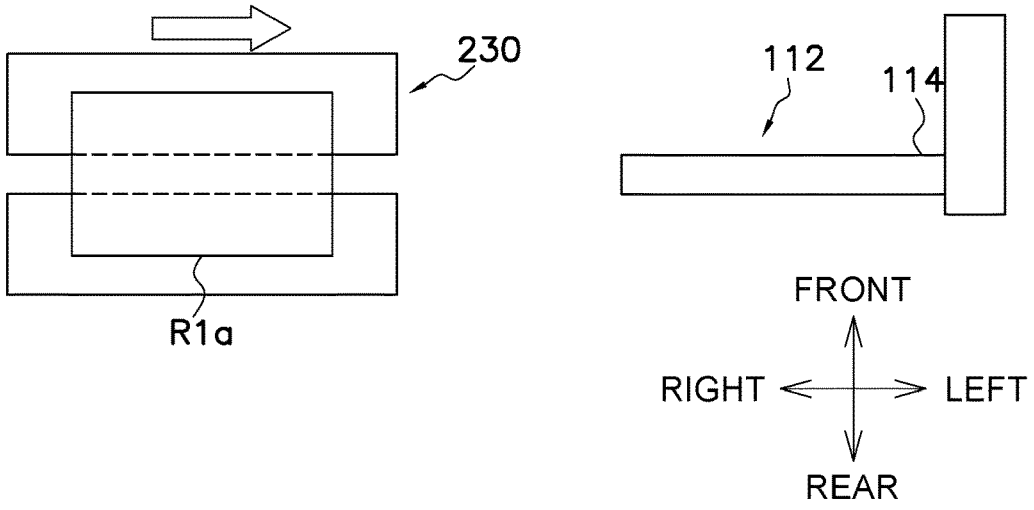
FIG. 13A is a schematic plan view of part of the film roll replacement device and illustrates mounting of a film roll on a supporting shaft of the bag making and packaging machine by the film roll replacement device.

It is presumed in the description below that at the point in time depicted in FIG. 13A, as seen in plan view, the holding section 230 is disposed in front of the gate 220 in an adjacent position (initial position), and the right-side pushing member 240 and the left-side pushing member 250 are disposed in the non-contact positions previously described.

First, the controller 290 controls the action of the right-side pushing-member-driving unit 242 to move the right-side pushing member 240 to a contact position where the member can be in contact with the right end surface of the first film roll R1*a*, and particularly a contact position where the member can at least be in contact with the winding core WC of the first film roll R1*a*.

Figure 13B:
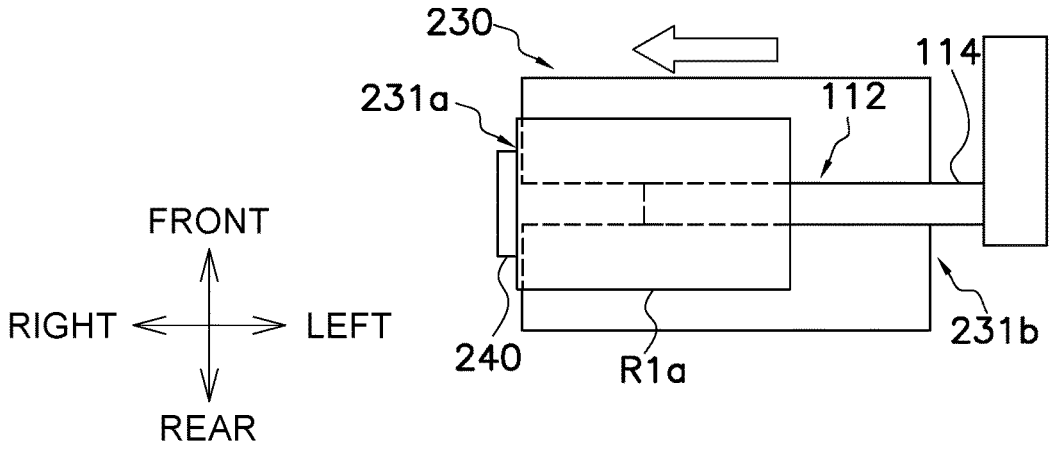
FIG. 13B is a schematic plan view of part of the film roll replacement device and illustrates the mounting of the film roll on the supporting shaft of the bag making and packaging machine by the film roll replacement device.
Figure 13C:
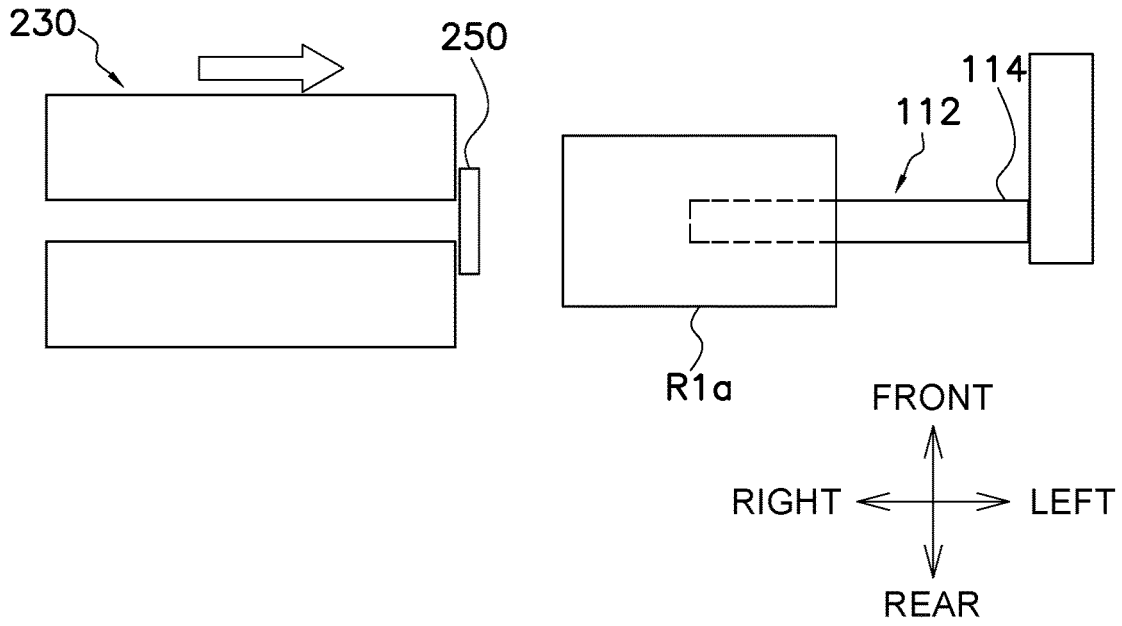
FIG. 13C is a schematic plan view of part of the film roll replacement device and illustrates the mounting of the film roll on the supporting shaft of the bag making and packaging machine by the film roll replacement device.

Next, the controller 290 controls the action of the third driving unit 237 to move the holding section 230 from the initial position leftward toward the supporting shaft 114 disposed in the film roll replacement position in FIG. 13B on the left side, and transfer the first film roll R1*a* held in the holding section 230 to the supporting part 112. This step shall now be described in detail.

When the controller 290 controls the action of the third driving unit 237 to move the holding section 230 leftward, the supporting shaft 114 is inserted into the hollow part of the winding core WC of the first film roll R1*a* held by the holding section 230, and the first film roll R1*a* of the holding section 230 is transferred to the supporting shaft 114. Particularly, when there is little difference between the outer diameter of the supporting shaft 114 and a diameter of the hollow part of the winding core WC, there are cases in which even if the holding section 230 is moved to the left, the first film roll R1*a* will not move to the left beyond a certain point due to friction between an inner surface of the hollow part of the winding core WC and an outer surface of the supporting shaft 114. However, because the right-side pushing member 240 is disposed adjacent to the first end portion 231*a* (right end portion) of the holding section 230, when the first film roll R1*a* comes to be disposed to the right of the first end portion 231*a* of the holding section 230, a right end surface of the first film roll R1*a* is pushed by the right-side pushing member 240 driven by the third driving unit 237, and the supporting shaft 114 is inserted deeper into the hollow part of the winding core WC of the first film roll R1*a* (see FIG. 13B). In other words, at this time, the controller 290 controls the action of the third driving unit 237 to cause the end surface of the first film roll R1*a* held by the holding section 230 to be pushed by the right-side pushing member 240 and the first film roll R1*a* moves to the supporting shaft 114.

When the region over which the holding section 230 can move left is sufficiently wide, the supporting shaft 114 can be sufficiently inserted into the hollow part of the winding core WC of the first film roll R1*a* by the right-side pushing member 240 alone, and the first film roll R1*a* can be set at a predetermined position on the supporting shaft 114.

Such a design makes it necessary to ensure sufficient area for the holding section 230 to move, presenting a possibility that the floor area required for installing the bag making and packaging machine 3 and the film roll replacement device 200 will increase. Therefore, the film roll replacement device 200 is preferably designed as follows.

When the second end portion 231*b* of the holding section 230 reaches the vicinity of a supporting end of the supporting shaft 114, the controller 290 controls the action of the second driving unit 236 to move the holding section 230 slightly downward, and controls the action of the third driving unit 237 to move the holding section 230 rightward to the initial position.

The controller 290 then controls the action of the right-side pushing-member-driving unit 242 to move the right-side pushing member 240 to the non-contact position. The controller 290 also controls the action of the left-side pushing-member-driving unit 252 to move the left-side pushing member 250 to a contact position where the member can be in contact with the right end surface of the first film roll R1*a* that has been moved to the supporting shaft 114, and particularly a contact position where the member can at least be in contact with the right end surface of the winding core WC of the first film roll R1*a*.

Figure 13D:
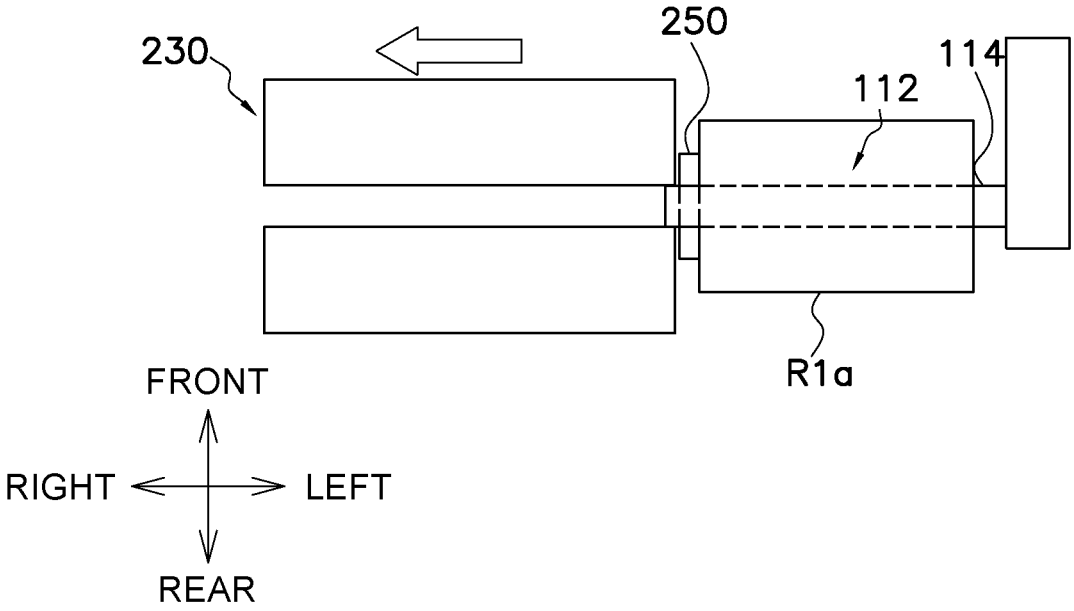
FIG. 13D is a schematic plan view of part of the film roll replacement device and illustrates the mounting of the film roll on the supporting shaft of the bag making and packaging machine by the film roll replacement device.
Figure 13E:
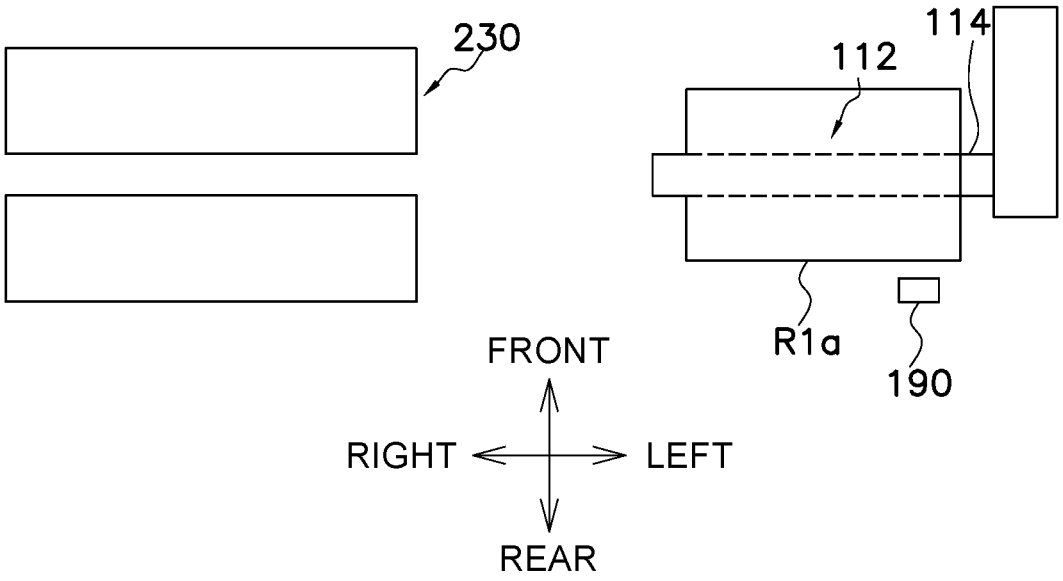
FIG. 13E is a schematic plan view of part of the film roll replacement device and illustrates the mounting of the film roll on the supporting shaft of the bag making and packaging machine by the film roll replacement device.

Next, the controller 290 controls the action of the third driving unit 237 to move the holding section 230 and the left-side pushing member 250 to the left to a predetermined position (the position depicted in FIG. 13D). This predetermined position is determined in advance according to factors such as the dimensions of the film rolls R1 to be used. As a result of the controller 290 controlling the actions of the film roll replacement device 200 in this manner, the first film roll R1*a* is positioned by the left-side pushing member 250 to be disposed in an appropriate position on the supporting shaft 114.

In the state depicted in FIG. 13D, the left-side pushing member 250 and the supporting shaft 114 are disposed in overlapping positions in the left-right direction. However, because the recess 250*a* is formed as previously described in the left-side pushing member 250, the supporting shaft 114 and the left-side pushing member 250 do not come into contact even if the left-side pushing member 250 and the supporting shaft 114 are disposed in overlapping positions in the left-right direction.

The controller 290 then issues a notification to the packaging machine controller 4 that the supply of the first film roll R1*a* to the supporting shaft 114 has ended. The controller 290 also controls the action of the third driving unit 237 to move the holding section 230 to the initial position (the same position as that depicted in FIG. 13A) at a predetermined timing (see FIG. 13E). The controller 290 controls the action of the left-side pushing-member-driving unit 252 to move the left-side pushing member 250 to the non-contact position described above (see FIG. 13E). Furthermore, the controller 290 controls the action of the second driving unit 236 to move the holding section 230 to the height position depicted in FIG. 12A at a predetermined timing.

If the timing at which the controller 290 moves the holding section 230 to the initial position and moves the left-side pushing member 250 to the non-contact position is delayed until the timing at which the packaging machine controller 4 controls the action of the fixing mechanism of the supporting shaft 114 to fix the first film roll R1*a* and the supporting shaft 114 together, the left-side pushing member 250 can also be given the function of restricting the position of the first film roll R1*a*.

Though this is not a detail pertaining to the actions of the film roll replacement device 200, at the point in time when the supply of the first film roll R1*a* to the supporting shaft 114 has ended and the first film roll R1*a* has been fixed to the supporting shaft 114, the packaging machine controller 4 preferably causes the first film roll R1*a* to rotate via the support-shaft-driving unit 116 and reads a bar code or matrix-type two-dimensional code (not shown in the figure) on the film roll R1 via the scanner 190 disposed near the supporting shaft 114 disposed in the film roll replacement position. The packaging machine controller 4 then preferably confirms whether or not the type of film roll R1 specified by the bar code or matrix-type two-dimensional code read by the scanner 190 matches the type of film roll R1 that should be mounted on the supporting shaft 114. This feature would make it possible to check if the correct film roll R1 has been supplied to the bag making and packaging machine 3 even if the film roll R1 is automatically supplied to the bag making and packaging machine 3.

(3) Characteristics (3-1)

A film roll replacement device 200, serving as an example of the film roll supply device in the claims, supplies a film roll R1 to a bag making and packaging machine 3. The film roll replacement device 200 comprises a holding section 230, a second driving unit 236 serving as an example of the driving unit in the claims, and a controller 290 serving as an example of the control unit in the claims. The holding section 230 is at least temporarily located adjacent to a supporting shaft 114 to support the film roll R1 in the bag making and packaging machine 3, and the holding section 230 holds a first film roll R1*a* serving as the film roll R1 supplied to the bag making and packaging machine 3. The second driving unit 236 moves the holding section 230 in an up-down direction. The controller 290 controls an action of the second driving unit 236 to move the holding section 230 to a position where a height position of a center of the first film roll R1*a* held by the holding section 230 is aligned with a height of a center of the supporting shaft 114 of the bag making and packaging machine 3.

With the film roll replacement device 200, the burden on the worker can be reduced because the height position of the film roll R1, which is a heavy object, supplied to the bag making and packaging machine 3 is automatically adjusted.

(4) Modifications

Modifications of the present embodiment are presented below. The modifications may be combined as appropriate provided no contradictions occur therebetween.

(4-1) Modification A

In the above embodiment, the controller 290 measures the diameter D of the first film roll R1*a* based on the signal output by the encoder 284 attached to a motor serving as the first-member-driving unit 282.

However, a measurement method based on the signal output by the encoder 284 is not provided by way of limitation to the method of measuring the diameter D of the first film roll R1*a*.

Figure 15:
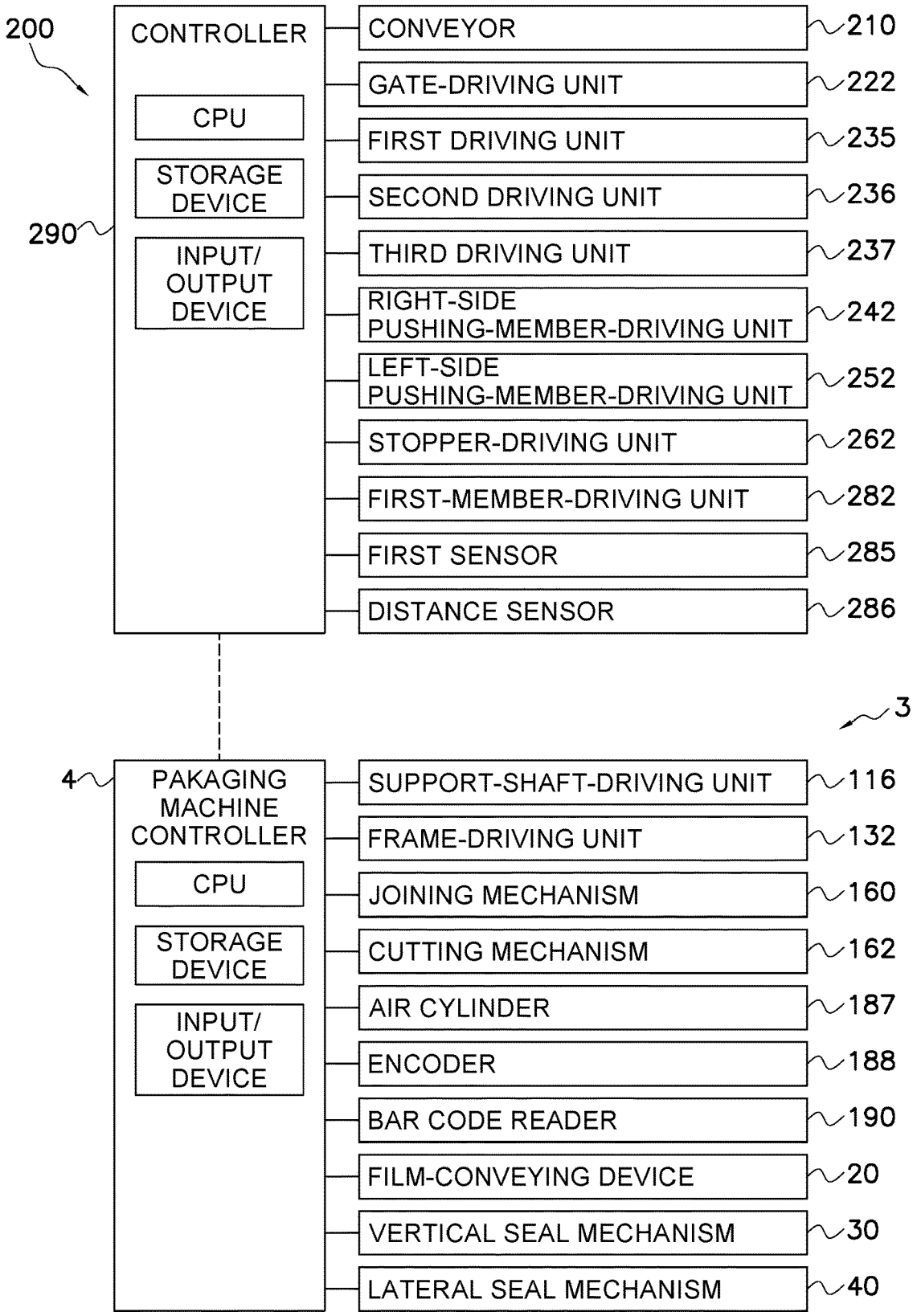
FIG. 15 is a control block diagram of the film roll replacement device of Modification A.

For example, the film roll replacement device 200 may have a first sensor 285 instead of the encoder 284 as shown in FIG. 15. In addition, the first-member-driving unit 282 may be an air cylinder or another driving mechanism other than a motor in this case. The first sensor 285 is located, for example, directly below the first member 280 or directly above the first member 280. The first sensor 285 is a laser distance sensor that contactlessly measures a first distance (a distance in the up-down direction in this modification) from a first reference position (e.g., a position where the first sensor 285 is installed) to the first member 280 in contact with the outer peripheral surface of the first film roll R1*a*.

The controller 290, serving as a first measuring unit, measures (calculates) the diameter D of the first film roll R1*a* based on the first distance measured by the first sensor 285. For example, a distance between the first reference position and the conveying surface of the conveyor 210 (the surface on which the first film roll R1*a* is placed) is stored in advance in a storage device of the controller 290. The controller 290 calculates the diameter D of the first film roll R1*a* from the first distance and the distance from the first reference position to the conveying surface of the conveyor 210.

(4-2) Modification B

In the above embodiment, the controller 290 serving as a first measuring unit measures the diameter D of the first film roll R1*a*, and based on the diameter D of the first film roll R1*a*, the controller 290 controls the action of the second driving unit 236 to move the holding section 230 to a position where the height position of the center of the first film roll R1*a* held by the holding section 230 is aligned with the height of the center of the support shaft 114 of the bag making and packaging machine 3.

Figure 16:
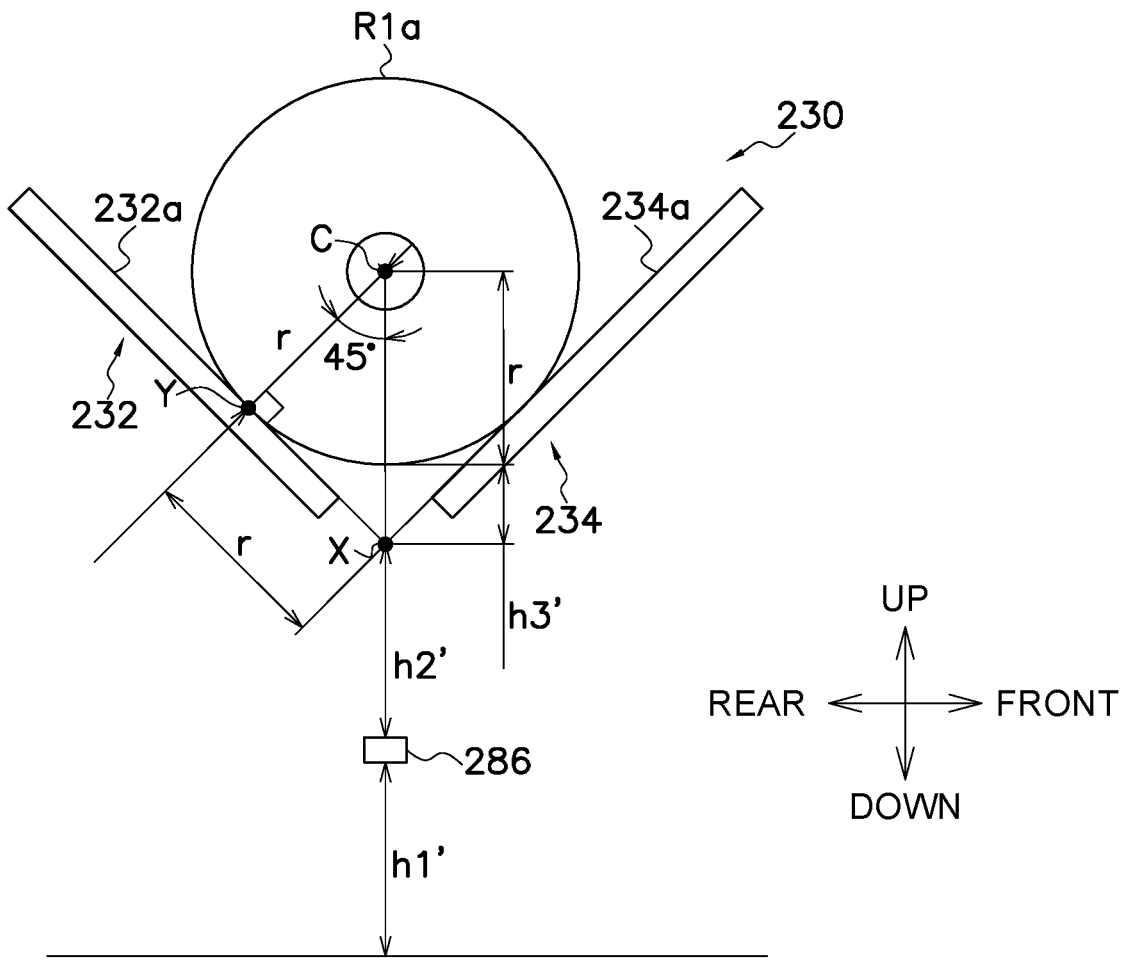
FIG. 16 is an enlarged view of the holding section of the film roll replacement device of Modification B, and illustrates a method of measuring the height position up to the center of the first film roll.

However, the controller 290 may measure the height position of the first film roll R1*a* held by the holding section 230 without measuring the diameter D of the first film roll R1*a*, and the controller 290 may use this measurement result as a basis to control the action of the second driving unit 236 to move the holding section 230 to a position where the height position of the center of the first film roll R1*a* held by the holding section 230 is aligned with the height of the center of the support shaft 114 of the bag making and packing machine 3. A specific example shall now be described with reference to FIG. 16. FIG. 16 is an enlarged view of the holding section 230 of the film roll replacement device 200, and illustrates the method of measuring the height position up to the center of the first film roll R1*a*.

In Modification B, the film roll replacement device 200 does not have the first member 280, the first-member-driving unit 282, or the encoder 284. In Modification B, the controller 290, serving as a second measuring unit, measures the height position of the center of the first film roll R1*a* held by the holding section 230. The controller 290 uses, for example, the measurement result from the distance sensor 286 previously described. In Modification B, the distance sensor 286 functions as a sensor that contactlessly measures a second distance from a second reference position (the position of the distance sensor 286) to the outer peripheral surface (the lowest part) of the first film roll R1*a* held by the holding section 230.

In the storage device of the controller 290 are stored, for example, a height h1' between the distance sensor 286 and the floor surface, and a height h2' between the distance sensor 286 and the intersection point X between the straight line imagined as an extension of the first holding surface 232*a* and the straight line imagined as an extension of the second holding surface 234*a* (see FIG. 16). It can be seen from the structure of the holding section 230 in the present modification that in a left-side view, the center C of the first film roll R1*a*, the intersection point X, and a line, the intersection point Y, that is extended from the center C of the first film roll R1*a* and that is perpendicular to the first holding surface 232*a* form a right isosceles triangle. Therefore, if the distance sensor 286 is able to measure a second distance (h2'+h3') from the position of the distance sensor 286 serving as the second reference position to the outer peripheral surface (the lowest part) of the second film roll R1*b*, the controller 290 can calculate the distance from the floor surface to the center C of the first film roll R1*a*, using the formula h1'+h2'+Root(2)×h3'/(Root(2)−1). The values of h1' and h2' are known, and the value of h3' can be calculated by subtracting the known value h2' from the second distance measured by the distance sensor 286.

In this modification, a case is assumed in which the angle formed by the first holding surface 232*a* and the second holding surface 234*a* is 90°, but the angle formed by the first holding surface 232*a* and the second holding surface 234*a* need not be 90°. In this case, the figure formed by connecting the center C of the first film roll R1*a*, the intersection point X, and the intersection point Y would not be a right isosceles triangle, but if the angle formed between the line segment joining the center C of the first film roll R1*a* and the line segment joining the intersection point X and the intersection point Y or the like is known, the height position of the first film roll R1*a* held by the holding section 230 can be measured (calculated) using a trigonometric function.

(4-3) Modification C

In the above embodiment, the first member 280 comes into contact with the outer peripheral surface of the first film roll R1*a* from above, but this feature is not provided by way of limitation. For example, the first member 280 may come into contact with the outer peripheral surface of the first film roll R1*a* from a side (e.g., from the rear). In this case as well, the controller 290 can measure the diameter D of the first film roll R1*a* using the same method as in the above embodiment.

(4-4) Modification D

In the above embodiment, the holding section 230, the right-side pushing member 240, and the left-side pushing member 250 are driven together by the third driving unit 237, but this feature is not provided by way of limitation. For example, the holding section 230, the right-side pushing member 240, and the left-side pushing member 250 may be driven by respective separate driving units. In addition, for example, one of the right-side pushing member 240 and the left-side pushing member 250 may together with the holding section 230 be driven by the third driving unit 237, and the other of the right-side pushing member 240 and the left-side pushing member 250 may be driven by a driving unit separate from the third driving unit 237.

(4-5) Modification E

In the above embodiment, the film roll replacement device 200 is a stationary device. However, the film roll replacement device 200 is not limited to being stationary, and may be, for example, a self-propelled device having wheels or another movement mechanism.

(4-6) Modification F

In the above embodiment, the controller 290 functions as the first measuring unit in the claims, and in Modification B, the controller 290 functions as the second measuring unit in the claims. However, this feature is not provided by way of limitation; the first measuring unit or the second measuring unit may be configured separate from the controller 290.

(4-7) Modification G

In the above embodiment, the controller 290 measures the diameter of the first film roll R1*a*, and adjusts the height position of the center of the first film roll R1*a* based on the measurement result. However, this feature is not provided by way of limitation; the controller 290 may, for example, adjust the height position of the center of the first film roll R1*a* based on a value of the diameter of the first film roll R1*a* input from an input device (not shown in the figure).

(4-8) Modification H

The winding-core-retrieving mechanism 270 need not be provided to the film roll replacement device 200. If the second film roll R1*b* is automatically removed from the second film roll R1*b* and the first film roll R1*a* is automatically attached to the support shaft 114, the winding-core-retrieving mechanism 270 is preferably provided to the film roll replacement device 200 in order to reduce the burden on the worker who takes away the second film roll R1*b* from the holding section 230 (the winding core WC of the depleted film roll R1).

(4-9) Modification I

If the winding-core-retrieving mechanism 270 is not provided and there is no need for the winding core WC of the depleted film roll R1 to fall from the gap 230*a* of the holding section 230, the holding section 230 may be a V-shaped member in which the first holding member 232 and the second holding member 234 of the above embodiment are integrated.

(4-10) Modification J

In the above embodiment, the holding section 230 is a V-shaped member, but the shape of the holding section 230 is not limited to that of a V. For example, the holding section 230 may be a flat plate-form member in which a groove extending in the left-right direction (a groove in which the film roll R1 will fit) is formed in the center in the front-rear direction.

(4-11) Modification K

In the film roll replacement device 200 of the above embodiment, the first film roll R1*a* is automatically mounted onto the supporting shaft 114 of the bag making and packaging machine 3 after the height position of the center of the first film roll R1*a* has been adjusted. However, the film roll replacement device 200 may be a device in which the first film roll R1*a* is not automatically mounted onto the supporting shaft 114 and only the adjustment of the height position of the center of the first film roll R1*a* is done automatically. In this case, for example, the holding section 230 may be moved manually in the left-right direction.

(4-12) Modification L

In the above embodiment, the controller 290, serving as the first measuring unit, measures the diameter D of the first film roll R1*a*. However, the diameter D of the first film roll R1*a* may be stored in a storage device of the controller 290. If the diameter D of a new first film roll R1*a* is constant, the action of the second driving unit 236 may be controlled based on the height position of the diameter D stored in the storage device without measurement to move the holding section 230 to a position where the height position of the center of the first film roll R1*a* held by the holding section 230 is aligned with the height of the center of the supporting shaft 114 of the bag making and packaging machine 3. The storage device may also store the diameters D of a plurality of film rolls R1. The amount the holding section 230 moves can be controlled in accordance with the type of film roll.

The claimed invention is useful as a film roll supply device to supply a film roll to a bag making and packaging machine.

REFERENCE SIGNS LIST

3 Bag making and packaging machine
114 Supporting shaft
200 Film roll replacement device (film roll supply device)
230 Holding section
232*a* First holding surface
234*a* Second holding surface
236 Second driving unit (driving unit)
280 First member
282 First-member-driving unit (movement mechanism)
290 Controller (control unit, first measuring unit, second measuring unit)
R1 Film roll
R1*a* First film roll
V Vertical plane

The invention claimed is:

1. A film roll supply device configured to supply a film roll to a bag making and packaging machine, the film roll supply device comprising:

a holding section that is configured to be located at least temporarily adjacent to a supporting shaft to support the film roll in the bag making and packaging machine, and that is configured to hold a first film roll serving as the film roll supplied to the bag making and packaging machine;

a driving unit configured to move the holding section in an up-down direction; and a control unit configured to control an action of the driving unit to move the holding section to a position where a height position of a center of the first film roll held by the holding section is aligned with a height of a center of the supporting shaft of the bag making and packaging machine; and a first measuring unit configured to measure a diameter of the first film roll, wherein the control unit is configured to control the action of the driving unit based on a measurement result from the first measuring unit to move the holding section to a position where the height position of the center of the first film roll held by the holding section is aligned with the height of the center of the supporting shaft of the bag making and packaging machine.

2. The film roll supply device according to claim 1, further comprising a first member; and a movement mechanism configured to move the first member from a first position to a second position where the first member contacts with an outer peripheral surface of the first film roll, wherein the first measuring unit is configured to measure the diameter of the first film roll based on a distance the first member moves from the first position to the second position.

3. The film roll supply device according to claim 1, further comprising a first member;

a movement mechanism configured to move the first member to a position where the first member contacts with an outer peripheral surface of the first film roll; and a first sensor configured to contactlessly measure a first distance from a first reference position to the first member in contact with the outer peripheral surface of the first film roll, wherein the first measuring unit is configured to measure the diameter of the first film roll based on the first distance.

4. The film roll supply device according to claim 1, wherein the holding section has a first holding surface and a second holding surface to support the first film roll; and the control unit is configured to control the action of the driving unit, when aligning the height position of the center of the first film roll held by the holding section with the height position of the center of the supporting shaft of the bag making and packaging machine, to move the holding section supporting the first film roll using the first holding surface, which is inclined with respect to a vertical plane, and the second holding surface, which is arranged symmetrically to the first holding surface with respect to the vertical plane; and the first holding surface and the second holding surface are arranged in a V shape when the holding section moved by the driving unit is viewed along the vertical plane.

5. The film roll supply device according to claim 1, further comprising a distance sensor configured to contactlessly measure a distance to an outer peripheral surface of the first film roll, wherein the control unit is configured to control the action of the driving unit based on the distance measured by the distance sensor.

6. The film roll supply device according to claim 1, further comprising a storage unit configured to store a diameter of the film roll, wherein the control unit is configured to control the action of the driving unit based on the diameter of the film roll stored in the storage unit.

7. A film roll supply device configured to supply a film roll to a bag making and packaging machine, the film roll supply device comprising:

a holding section that is configured to be located at least temporarily adjacent to a supporting shaft to support the film roll in the bag making and packaging machine, and that is configured to hold a first film roll serving as the film roll supplied to the bag making and packaging machine;

a driving unit configured to move the holding section in an up-down direction;

a control unit configured to control an action of the driving unit to move the holding section to a position where a height position of a center of the first film roll held by the holding section is aligned with a height of a center of the supporting shaft of the bag making and packaging machine; and a measuring unit configured to measure the height position of the center of the first film roll held by the holding section, wherein, based on a measurement result from the measuring unit, the control unit is configured to control the action of the driving unit to move the holding section to a position where the height position of the center of the first film roll held by the holding section is aligned with the height of the center of the supporting shaft of the bag making and packaging machine.

8. The film roll supply device according to claim 7, further comprising a sensor configured to contactlessly measure a distance from a reference position to an outer peripheral surface of the first film roll, wherein the measuring unit is configured to measure the height position of the center of the first film roll held by the holding section based on the distance measurement result from the sensor.

9. The film roll supply device according to claim 7, wherein the holding section has a first holding surface and a second holding surface to support the first film roll; and the control unit is configured to control the action of the driving unit, when aligning the height position of the center of the first film roll held by the holding section with the height position of the center of the supporting shaft of the bag making and packaging machine, to move the holding section supporting the first film roll using the first holding surface, which is inclined with respect to a vertical plane, and the second holding surface, which is arranged symmetrically to the first holding surface with respect to the vertical plane; and the first holding surface and the second holding surface are arranged in a V shape when the holding section moved by the driving unit is viewed along the vertical plane.

10. The film roll supply device according to claim 7, further comprising a distance sensor configured to contactlessly measure a distance to an outer peripheral surface of the first film roll, wherein the control unit is configured to control the action of the driving unit based on the distance measured by the distance sensor.

11. The film roll supply device according to claim 7, further comprising a storage unit configured to store a diameter of the film roll, wherein the control unit is configured to control the action of the driving unit based on the the diameter of the film roll stored in the storage unit.

* * * * *